US008973755B2

(12) United States Patent
Key

(10) Patent No.: US 8,973,755 B2
(45) Date of Patent: Mar. 10, 2015

(54) COMPLIANCE AID LABELING FOR MEDICATION CONTAINERS

(75) Inventor: Stephen M. Key, Modesto, CA (US)

(73) Assignee: SpinLabel Technologies, Inc., Boca Raton, FL (US)

( * ) Notice: Subject to any disclaimer, the term of this patent is extended or adjusted under 35 U.S.C. 154(b) by 0 days.

(21) Appl. No.: 13/358,466

(22) Filed: Jan. 25, 2012

(65) Prior Publication Data

US 2013/0026056 A1 Jan. 31, 2013

Related U.S. Application Data

(60) Provisional application No. 61/511,817, filed on Jul. 26, 2011.

(51) Int. Cl.

| | |
|---|---|
| ***G09F 11/02*** | (2006.01) |
| ***G09F 3/00*** | (2006.01) |
| ***A61J 7/04*** | (2006.01) |
| ***G09F 3/10*** | (2006.01) |
| *G09F 3/02* | (2006.01) |

(52) U.S. Cl.

CPC ..... *A61J 7/04* (2013.01); *G09F 3/0288* (2013.01); *G09F 3/10* (2013.01); *G09F 2003/0273* (2013.01); *A61J 2200/30* (2013.01); *A61J 2205/30* (2013.01)

USPC ..... 206/459.1; 40/306; 40/310; 206/534

(58) Field of Classification Search

USPC ..... 156/215, 229; 40/306, 310, 506; 116/306–324; 206/459.1, 534

See application file for complete search history.

(56) References Cited

U.S. PATENT DOCUMENTS

| | | | |
|---|---|---|---|
| 332,208 | A | 12/1885 | Noel |
| 736,035 | A | 8/1903 | Stevenson |
| 1,054,826 | A | 3/1913 | Cole |
| 1,064,576 | A | 6/1913 | Washburn |
| 1,145,367 | A | 7/1915 | Herter |
| 1,312,611 | A | 8/1919 | Chess |
| 1,317,660 | A | 9/1919 | Carlson |
| 1,334,031 | A | 3/1920 | Hahn |
| 1,387,625 | A | 8/1921 | Stein |
| 1,486,313 | A | 3/1924 | Van Antwerp |
| 2,013,616 | A | 9/1935 | Rettenmeyer |
| 2,069,609 | A | 2/1937 | Hanson |
| 2,129,364 | A | 9/1938 | Simons et al. |

(Continued)

FOREIGN PATENT DOCUMENTS

| | | |
|---|---|---|
| AT | 932891 | 4/2002 |
| AT | 1165378 | 9/2004 |

(Continued)

OTHER PUBLICATIONS

International Search Report and Written Opinion mailed May 25, 2012 in Patent Cooperation Treaty Application No. PCT/US12/22609, filed Jan. 25, 2012.

(Continued)

*Primary Examiner* — Bryon Gehman
(74) *Attorney, Agent, or Firm* — Carr & Ferrell LLP

(57) ABSTRACT

The present application is directed to patient compliance aids for a medicine container. A base label may be adhered to the medication container, and one or more indicia disposed on the base label. A top label may cover at least a portion of the base label.

32 Claims, 24 Drawing Sheets

(56) References Cited

U.S. PATENT DOCUMENTS 2,441,607 A 5/1948 Walls
2,468,000 A 4/1949 Taylor
2,487,274 A 11/1949 Schaffer
2,504,076 A 4/1950 Lindblom
2,706,464 A 4/1955 North
2,738,564 A 3/1956 Guianne
2,739,564 A 3/1956 North
2,844,893 A 7/1958 Keller
2,860,431 A 11/1958 Barnum
2,931,657 A 4/1960 Lewis
2,935,814 A 5/1960 Freeze
2,971,283 A 2/1961 Parker
3,233,770 A 2/1966 Waters
3,278,182 A 10/1966 Lescher
3,374,911 A 3/1968 White
D210,767 S 4/1968 Anglada
3,375,954 A 4/1968 Honkanen et al.
3,468,467 A 9/1969 Amberg
3,488,880 A 1/1970 Taylor
3,523,623 A 8/1970 Dorn
3,542,229 A 11/1970 Beyerlein et al.
3,604,584 A 9/1971 Shank
3,633,781 A 1/1972 Zapata
3,733,002 A 5/1973 Fujio
3,750,317 A 8/1973 Morgan
3,766,882 A 10/1973 Babbitt, III
3,779,829 A 12/1973 Wolff
3,865,671 A 2/1975 Kronsder
3,874,977 A 4/1975 Pyles
3,960,713 A 6/1976 Carey
4,044,889 A 8/1977 Orentreich et al.
4,057,251 A 11/1977 Jones et al.
4,072,553 A 2/1978 Braker et al.
4,203,240 A 5/1980 Goodwin
4,312,523 A 1/1982 Haines
4,318,683 A 3/1982 Fishbaugh et al.
4,381,615 A 5/1983 Lonsmin
4,405,045 A 9/1983 Villa-Real
4,473,429 A 9/1984 Crankshaw
4,505,497 A 3/1985 Katzman
4,518,450 A 5/1985 Warmann
4,533,586 A 8/1985 Roule et al.
4,567,681 A 2/1986 Fumei
4,589,943 A 5/1986 Kimball et al.
4,658,974 A 4/1987 Fujita et al.
4,680,080 A 7/1987 Instance
4,700,976 A 10/1987 Loose
4,724,973 A 2/1988 Shah
4,727,667 A 3/1988 Ingle
4,732,411 A 3/1988 Siegel
4,844,760 A 7/1989 Dickey
4,877,119 A 10/1989 Hosking
4,918,604 A 4/1990 Baum
4,920,912 A 5/1990 Kirkling
4,955,153 A 9/1990 Albrecht et al.
D311,423 S * 10/1990 DeSantis ..... D20/22
5,017,261 A 5/1991 Zodrow et al.
5,048,870 A 9/1991 Mangini et al.
5,062,917 A 11/1991 Zodrow
5,076,613 A 12/1991 Kovacs
5,078,826 A 1/1992 Rogall
5,116,452 A 5/1992 Eder
5,154,448 A 10/1992 Griffin et al.
5,207,011 A 5/1993 Coulthard
5,209,367 A 5/1993 Van Musscher et al.
5,215,622 A 6/1993 Schmelzer
5,263,743 A 11/1993 Jones
5,264,265 A 11/1993 Kaufmann
5,284,363 A 2/1994 Gartner et al.
5,321,933 A 6/1994 Seifert et al.
5,324,559 A 6/1994 Brombacher
5,342,093 A 8/1994 Weernink
5,363,576 A 11/1994 Piana et al.
5,370,754 A 12/1994 Soloman
5,403,635 A 4/1995 Hoffman
5,403,636 A 4/1995 Crum
5,405,482 A 4/1995 Morrissette et al.
5,462,488 A 10/1995 McKillip
5,484,167 A 1/1996 Donaldson et al.
D368,234 S 3/1996 Dickinson et al.
5,525,383 A 6/1996 Witkowski
5,605,230 A 2/1997 Marino, Jr. et al.
5,605,730 A 2/1997 Treleaven
5,639,529 A 6/1997 Gozdecki et al.
D383,038 S 9/1997 Willbrandt
D386,947 S 12/1997 Lapierre et al.
5,712,021 A 1/1998 Hernandez
5,727,766 A 3/1998 Mayo
5,727,819 A 3/1998 Grosskopf et al.
5,738,382 A 4/1998 Grosskopf et al.
5,741,381 A 4/1998 Dolence et al.
5,758,096 A 5/1998 Barsky et al.
5,799,525 A 9/1998 Johnson et al.
5,800,893 A 9/1998 Harden
5,809,674 A 9/1998 Key
5,829,789 A 11/1998 Treleaven et al.
5,830,550 A 11/1998 Treleaven et al.
5,842,633 A 12/1998 Nurse
5,863,628 A 1/1999 Barry
5,883,370 A 3/1999 Walker et al.
5,884,421 A * 3/1999 Key ..... 40/306
5,953,170 A 9/1999 Glancy
5,975,582 A 11/1999 Treleaven
6,027,780 A 2/2000 Treleaven et al.
6,035,568 A 3/2000 Grosskopf et al.
6,047,488 A 4/2000 Tuszkiewicz
6,048,423 A 4/2000 Barrash et al.
6,057,019 A 5/2000 Barry
D428,307 S 7/2000 Yeandel
6,086,697 A * 7/2000 Key ..... 40/306
6,120,637 A 9/2000 Barry
6,129,802 A 10/2000 Key
6,129,959 A 10/2000 Mercer et al.
6,158,612 A 12/2000 Alpert
D436,499 S 1/2001 Pritchard et al.
6,212,803 B1 4/2001 Key
6,213,520 B1 4/2001 Treleaven et al.
6,237,269 B1 5/2001 Key
6,253,438 B1 7/2001 Jespersen
6,254,138 B1 7/2001 Rawlings et al.
6,258,200 B1 7/2001 Kassab
6,267,672 B1 7/2001 Vance
D446,687 S 8/2001 Furman et al.
6,270,121 B1 8/2001 Dolan et al.
6,274,236 B1 8/2001 Shacklett et al.
6,276,533 B1 8/2001 Kaplan
6,328,832 B1 12/2001 Otruba et al.
6,329,034 B1 12/2001 Pendry et al.
6,360,462 B1 3/2002 Mengel
6,385,878 B1 5/2002 Key
6,398,263 B2 6/2002 Treleaven et al.
6,402,872 B1 * 6/2002 Key ..... 156/215
6,413,345 B1 7/2002 Treleaven
D461,369 S 8/2002 Sims et al.
6,428,639 B1 8/2002 Oldenburg et al.
6,431,241 B1 8/2002 Gonzalo
6,454,094 B1 * 9/2002 Salani ..... 206/459.1
6,550,171 B1 4/2003 De Werra et al.
6,550,512 B2 4/2003 Yang
6,561,246 B2 5/2003 Yang
6,575,216 B2 6/2003 Yang
6,581,773 B2 * 6/2003 Kaplan ..... 206/534
6,616,189 B2 9/2003 Raming
6,622,878 B1 9/2003 Frey
6,631,578 B2 10/2003 Key
6,649,007 B1 * 11/2003 Key ..... 156/215
6,669,804 B2 12/2003 Pendry et al.
6,722,568 B2 4/2004 Blanford et al.
6,737,137 B2 5/2004 Franko, Sr. et al.
6,752,431 B1 6/2004 Matthews et al.
6,755,442 B2 6/2004 Franko, Sr. et al.
6,779,480 B2 8/2004 Zamjahn
6,786,515 B2 9/2004 Franko, Sr.
6,793,075 B1 9/2004 Jeter

(56) References Cited

U.S. PATENT DOCUMENTS

| | | | | |
|---|---|---|---|---|
| 6,793,755 | B2 | 9/2004 | Schaupp et al. | |
| 6,811,640 | B2 | 11/2004 | Franko, Sr. | |
| 6,904,867 | B2 | 6/2005 | Zamjahn | |
| D526,847 | S | 8/2006 | Freeman | |
| 7,087,298 | B2 * | 8/2006 | Key | 40/306 |
| D527,583 | S | 9/2006 | Freeman | |
| D533,748 | S | 12/2006 | Bresler | |
| 7,172,220 | B2 | 2/2007 | Franko, Sr. | |
| 7,172,668 | B2 * | 2/2007 | Key | 40/306 |
| 7,179,514 | B2 | 2/2007 | Olsen et al. | |
| 7,325,510 | B2 * | 2/2008 | Giewercer | 116/324 |
| 7,601,410 | B2 | 10/2009 | Matthews et al. | |
| 7,621,231 | B2 | 11/2009 | McNeely | |
| 7,628,427 | B2 | 12/2009 | Adler et al. | |
| 7,782,479 | B2 | 8/2010 | Handa et al. | |
| 7,875,142 | B2 | 1/2011 | Matthews et al. | |
| 7,926,851 | B2 | 4/2011 | Kaufman | |
| 8,037,628 | B2 | 10/2011 | Kaufman | |
| 8,043,993 | B2 | 10/2011 | Roth et al. | |
| D649,396 | S | 11/2011 | Wilkens et al. | |
| 8,142,596 | B1 | 3/2012 | Valenti, Jr. et al. | |
| 8,245,752 | B2 | 8/2012 | Lingier et al. | |
| 8,272,562 | B2 | 9/2012 | Ziegler | |
| 8,413,884 | B2 | 4/2013 | Lim et al. | |
| 8,424,761 | B2 | 4/2013 | Yanagi | |
| D682,088 | S | 5/2013 | de Urquijo Carmona | |
| 8,709,198 | B2 | 4/2014 | Key | |
| 8,727,220 | B2 | 5/2014 | Key | |
| D706,624 | S | 6/2014 | Key | |
| D706,625 | S | 6/2014 | Key | |
| 2001/0004152 | A1 | 6/2001 | Treleaven et al. | |
| 2001/0017181 | A1 | 8/2001 | Otruba et al. | |
| 2001/0025442 | A1 | 10/2001 | Key | |
| 2001/0045741 | A1 | 11/2001 | Shacklett et al. | |
| 2001/0050242 | A1 | 12/2001 | Kaplan | |
| 2002/0015813 | A1 | 2/2002 | Pendry et al. | |
| 2002/0017784 | A1 | 2/2002 | Merry et al. | |
| 2002/0029635 | A1 | 3/2002 | Kremen | |
| 2002/0038685 | A1 | 4/2002 | Key | |
| 2002/0096261 | A1 | 7/2002 | Yang | |
| 2002/0096262 | A1 | 7/2002 | Yang | |
| 2002/0096264 | A1 | 7/2002 | Yang | |
| 2002/0104613 | A1 * | 8/2002 | Key | 156/229 |
| 2002/0130182 | A1 | 9/2002 | Mondie | |
| 2002/0139292 | A1 * | 10/2002 | Giewercer | 116/308 |
| 2002/0185212 | A1 | 12/2002 | Schaupp et al. | |
| 2002/0193225 | A1 | 12/2002 | Raming | |
| 2003/0006606 | A1 | 1/2003 | Franko, Sr. et al. | |
| 2003/0012911 | A1 | 1/2003 | Campbell | |
| 2003/0015105 | A1 | 1/2003 | Dewig et al. | |
| 2003/0030270 | A1 | 2/2003 | Franko, Sr. et al. | |
| 2003/0091819 | A1 | 5/2003 | Franko, Sr. | |
| 2003/0118768 | A1 | 6/2003 | Sellars | |
| 2003/0137145 | A1 | 7/2003 | Fell et al. | |
| 2003/0175463 | A1 | 9/2003 | Olsen et al. | |
| 2003/0189490 | A1 | 10/2003 | Hogerton et al. | |
| 2003/0201064 | A1 | 10/2003 | Treleaven et al. | |
| 2004/0108237 | A1 | 6/2004 | McClintock | |
| 2004/0123565 | A1 | 7/2004 | Rice et al. | |
| 2004/0166277 | A1 | 8/2004 | Key | |
| 2004/0188998 | A1 | 9/2004 | Henthorn | |
| 2004/0197513 | A1 | 10/2004 | Shacklett et al. | |
| 2004/0207193 | A1 | 10/2004 | Franko, Sr. | |
| 2004/0247863 | A1 | 12/2004 | Scott | |
| 2005/0038558 | A1 | 2/2005 | Keene | |
| 2005/0056203 | A1 | 3/2005 | Giewercer | |
| 2005/0097004 | A1 | 5/2005 | Masse Blume | |
| 2005/0181165 | A1 | 8/2005 | Franko, Sr. | |
| 2005/0183982 | A1 * | 8/2005 | Giewercer | 206/534 |
| 2005/0190914 | A1 | 9/2005 | Chen et al. | |
| 2005/0209870 | A1 | 9/2005 | Alden | |
| 2006/0029761 | A1 | 2/2006 | Matthews et al. | |
| 2006/0032923 | A1 | 2/2006 | Krupa | |
| 2006/0078701 | A1 | 4/2006 | Glasier | |
| 2006/0145471 | A1 | 7/2006 | Franko, Sr. | |
| 2006/0249950 | A1 | 11/2006 | Kenney et al. | |
| 2007/0029787 | A1 | 2/2007 | Loftin, III et al. | |
| 2007/0034103 | A1 | 2/2007 | Kaufman | |
| 2007/0043530 | A1 | 2/2007 | O'Rourke | |
| 2007/0119542 | A1 | 5/2007 | Williams et al. | |
| 2007/0209753 | A1 | 9/2007 | Gonzalez et al. | |
| 2007/0209755 | A1 | 9/2007 | Smith | |
| 2007/0213214 | A1 | 9/2007 | Roth et al. | |
| 2007/0221319 | A1 | 9/2007 | Morgan | |
| 2007/0222205 | A1 | 9/2007 | Handa et al. | |
| 2007/0252379 | A1 | 11/2007 | Bethune et al. | |
| 2007/0299693 | A1 | 12/2007 | Jung et al. | |
| 2008/0003391 | A1 | 1/2008 | Franko et al. | |
| 2008/0003410 | A1 | 1/2008 | Shacklett et al. | |
| 2008/0010874 | A1 | 1/2008 | Londino | |
| 2008/0014344 | A1 | 1/2008 | Fort et al. | |
| 2008/0073902 | A1 | 3/2008 | Franko | |
| 2008/0121688 | A1 | 5/2008 | Harrop | |
| 2008/0176955 | A1 | 7/2008 | Heck et al. | |
| 2008/0208694 | A1 | 8/2008 | Baggott | |
| 2008/0233405 | A1 | 9/2008 | Dronzek, Jr. | |
| 2008/0303264 | A1 | 12/2008 | Kaufman | |
| 2008/0303265 | A1 | 12/2008 | Kaufman | |
| 2009/0236023 | A1 | 9/2009 | Lingier et al. | |
| 2009/0255623 | A1 | 10/2009 | Bagung et al. | |
| 2009/0265188 | A1 | 10/2009 | Lamy et al. | |
| 2009/0294521 | A1 | 12/2009 | de la Huerga | |
| 2010/0043267 | A1 | 2/2010 | Sterling | |
| 2010/0044438 | A1 | 2/2010 | Chen et al. | |
| 2010/0084077 | A1 | 4/2010 | Matthews et al. | |
| 2010/0101681 | A1 | 4/2010 | Kramer et al. | |
| 2010/0228615 | A1 | 9/2010 | Hays | |
| 2010/0240133 | A1 | 9/2010 | Brivanlou et al. | |
| 2010/0295916 | A1 | 11/2010 | Kaufman | |
| 2010/0300599 | A1 | 12/2010 | Fort et al. | |
| 2010/0307947 | A1 | 12/2010 | Marden et al. | |
| 2011/0061802 | A1 | 3/2011 | Raming | |
| 2011/0151115 | A1 | 6/2011 | Lingier | |
| 2011/0169602 | A1 | 7/2011 | Gaffney | |
| 2011/0185606 | A1 | 8/2011 | Londino | |
| 2011/0233095 | A1 | 9/2011 | Seidl | |
| 2012/0006712 | A1 | 1/2012 | Kaplan et al. | |
| 2012/0010299 | A1 | 1/2012 | Kaplan et al. | |
| 2012/0037299 | A1 | 2/2012 | Baeta et al. | |
| 2012/0085828 | A1 | 4/2012 | Ziegler | |
| 2012/0118503 | A1 | 5/2012 | Lorence et al. | |
| 2012/0125526 | A1 | 5/2012 | Key | |
| 2012/0175336 | A1 | 7/2012 | Miller et al. | |
| 2012/0268837 | A1 | 10/2012 | Rittenburg et al. | |
| 2012/0279632 | A1 | 11/2012 | Lingier et al. | |
| 2012/0292219 | A1 | 11/2012 | Terwilliger et al. | |
| 2013/0025175 | A1 | 1/2013 | Key | |
| 2013/0025529 | A1 | 1/2013 | Key | |
| 2013/0026747 | A1 | 1/2013 | Key | |
| 2013/0033031 | A1 | 2/2013 | Key | |
| 2013/0036634 | A1 | 2/2013 | Key | |
| 2013/0036641 | A1 | 2/2013 | Key | |
| 2013/0037619 | A1 | 2/2013 | Key | |
| 2013/0043157 | A1 | 2/2013 | Key | |
| 2013/0062239 | A1 | 3/2013 | Key | |
| 2013/0129971 | A1 | 5/2013 | Key et al. | |
| 2014/0076766 | A1 | 3/2014 | Key | |

FOREIGN PATENT DOCUMENTS

| | | |
|---|---|---|
| AU | 723118 | 11/2000 |
| BE | 932891 | 4/2002 |
| BE | 1165378 | 9/2004 |
| CH | 932891 | 4/2002 |
| CH | 1165378 | 9/2004 |
| DE | 69711903.3-08 | 4/2002 |
| DE | 1165378 | 9/2004 |
| DK | 85214 | 3/1958 |
| DK | 932891 | 4/2002 |
| EP | 932891 | 4/2002 |
| EP | 1165378 | 9/2004 |
| EP | 2742501 | 6/2014 |
| ES | 932891 | 4/2002 |
| FR | 965522 | 9/1950 |

(56) References Cited

FOREIGN PATENT DOCUMENTS

| | | |
|---|---|---|
| FR | 1114750 | 4/1956 |
| FR | 1347102 | 11/1963 |
| FR | 2460260 | 1/1981 |
| FR | 285514 | 10/1988 |
| FR | 2677786 | 12/1992 |
| FR | 932891 | 4/2002 |
| FR | 1165378 | 9/2004 |
| GB | 932891 | 4/2002 |
| HK | 1039770 | 5/2002 |
| HK | 1021056 | 7/2002 |
| IE | 932891 | 4/2002 |
| IE | 1E1165378 | 9/2004 |
| IT | 327286 | 7/1935 |
| IT | 932891 | 4/2002 |
| MX | 204456 | 9/2002 |
| MX | 225535 | 1/2005 |
| MX | 227727 | 5/2005 |
| NL | 932891 | 4/2002 |
| NZ | 334683 | 11/1999 |
| SE | 1565 | 7/1888 |
| SE | 932891 | 4/2002 |
| WO | WO98/19289 | 5/1998 |
| WO | WO00/48161 | 8/2000 |
| WO | WO03017174 | 2/2003 |
| WO | WO2007020628 | 2/2007 |
| WO | WO2012071355 | 5/2012 |
| WO | WO2013015838 | 1/2013 |
| WO | WO2013015839 | 1/2013 |
| WO | WO2013016364 | 1/2013 |
| WO | WO2013016461 | 1/2013 |
| WO | WO2013019907 | 2/2013 |
| WO | WO2013022495 | 2/2013 |
| WO | WO2013022508 | 2/2013 |
| WO | WO2013023221 | 2/2013 |
| WO | WO2013025947 | 2/2013 |
| WO | WO2013039578 | 3/2013 |
| WO | WO2013043618 | 3/2013 |
| WO | WO2014047077 | 3/2014 |

OTHER PUBLICATIONS

International Search Report and Written Opinion mailed May 23, 2012 in Patent Cooperation Treaty Application No. PCT/US2012/022610, filed Jan. 25, 2012.

International Search Report and Written Opinion mailed Oct. 9, 2012 in Patent Cooperation Treaty Application No. PCT/US2012/048021, filed Jul. 24, 2012.

International Search Report and Written Opinion mailed Oct. 23, 2012 in Patent Cooperation Treaty Application No. PCT/US2012/050643, filed Aug. 13, 2012.

International Search Report and Written Opinion mailed Nov. 30, 2012 in Patent Cooperation Treaty Application No. PCT/US2012/055948, filed Sep. 18, 2012.

International Search Report and Written Opinion mailed Jul. 26, 2012 in Patent Cooperation Treaty Application No. PCT/US2012/037395, filed May 10, 2012.

International Search Report and Written Opinion mailed Oct. 16, 2012 in Patent Cooperation Treaty Application No. PCT/US2012/048201, filed Jul. 25, 2012.

International Search Report and Written Opinion mailed Jul. 9, 2012 in Patent Cooperation Treaty Application No. PCT/US2012/031670, filed Mar. 30, 2012.

International Search Report and Written Opinion mailed Oct. 23, 2012 in Patent Cooperation Treaty Application No. PCT/US2012/051228, filed Aug. 16, 2012.

International Search Report and Written Opinion mailed Oct. 16, 2012 in Patent Cooperation Treaty Application No. PCT/US2012/049234, filed Aug. 1, 2012.

International Search Report and Written Opinion mailed Aug. 27, 2012 in Patent Cooperation Treaty Application No. PCT/US2012/040301, filed May 31, 2012.

Newswire, "AccuDial(R) Pharmaceutical, Inc. can put an end to underdosing and overdosing with new line of children's over-the-counter medications", Jul. 8, 2010 [retrieved Dec. 12, 2013]. Retrieved from Internet: <http://www.newswire.ca/en/story/646945/accudial-r-pharmaceutical-inc-can-put-an-end-to-underdosing-and-overdosing-with-new-line-of-children-s-over-the-counter-medications>.

Accudial Pharmaceutical, Inc. company website, www.accuratedose.com, Oct. 30, 2010 [retrieved Aug. 7, 2012). Retrieved from Internet: <http://web.archive.org/web/20101030115353/http://www.accuratedose.com.ca_english/home>.

Anonymous, "Chest congestion (guaifenesin) liquid", Internet article, http://dailymed.nlm.nih.gov/dailymed/druginfo.cfm?id=25295. (Oct. 26, 2009).

Anonymous, "Pharmaceutical & medical packaging news", The packaging magazine for the healthcare industry, 16: 12:76-78, Internet article, http://www.accuratedose.com/corporate/assets/pdf/PMP_MagReprinIDec08.pdf, (Dec. 12, 2008).

A. Abramson, "Start-up has twist on safe doses for kids", Internet article, http://www.accuratedose.com/corporate/assets/pdf/50840_ACC_PBP_Article. pdf, (Jul. 27,2009).

Anonymous, "Chest congestion guaifenesin oral solution expectorant", Internet article, http://accuratedose.com/us_english/producUnformation/chest_congestion.html, (Aug. 24, 2011).

International Search Report and Written Opinion mailed Apr. 2, 2012 in Patent Cooperation Treaty Application No. PCT/US2011/061739, filed Nov. 21, 2011.

International Search Report and Written Opinion mailed Feb. 28, 2014 in Patent Cooperation Treaty Application No. PCT/US2013/060220, filed Sep. 17, 2013.

* cited by examiner

COMPLIANCE AID LABELING FOR MEDICATION CONTAINERS

CROSS-REFERENCE TO RELATED APPLICATIONS

The present application claims priority to provisional U.S. patent application Ser. No. 61/511,817, filed on Jul. 26, 2011, titled "Reminder Packaging for Improving Adherence for Self-Administered Medications," which is hereby incorporated by reference in its entirety.

FIELD OF THE INVENTION

The present application is directed generally to labels, and more specifically to medication container labels that function as a compliance aid for proper usage of the medicine.

BACKGROUND

More than three billion prescriptions are written each year in the United States, and an estimated $18 billion is spent on over-the-counter medications. Both prescription and over-the-counter medications are intended to be consumed by a patient according to specific instructions for dosage and frequency. Non-compliance with these instructions has been identified as a major obstacle to the effective delivery of health care. Compliance typically means consuming the correct dosage at the correct frequency as specified in the prescription or on the over-the-counter medication packaging. According to the World Health Organization, only about half of patients with chronic diseases living in developed countries comply with their medication instructions. The reasons for non-compliance are varied, ranging from simple forgetfulness, to confusion, to ambivalence. However, the effects of non-compliance are staggering, resulting in an estimated $290 billion dollars per year in avoidable medical expenses. Additionally, studies have shown that non-compliance results in about 125,000 deaths annually in the United States, and leads to 10-25 percent of hospital and nursing home admissions.

SUMMARY

The present application is directed to patient compliance aids for a medication container and methods for patient compliance with a regimen for administration of medication. An exemplary patient compliance aid may comprise a base label adhered to a medication container, and day of week indicia disposed on the base label. A time of day indicia may be associated with the day of week indicia and may also be disposed on the base label. The patient compliance aid may further comprise a top label covering at least a portion of the base label.

According to additional exemplary embodiments, the present application may be directed to methods for patient compliance with a regimen for administration of medication from a medication container. An exemplary method may comprise adhering a base label to the medication container, and displaying an indicator on the base label. The indicator may include a symbol or character representing that medication remains in the medication container. A receiving mechanism may be associated with the indicator. The receiving mechanism may be adapted to receive an entry when the medication is removed from the medication container and consumed by the patient. At least a portion of the base label may be covered with a top label.

DETAILED DESCRIPTION

The present application is directed to patient compliance aids for a medication container and methods for patient compliance with a regimen for administration of medication. An exemplary patient compliance aid may comprise a base label adhered to a medication container, and day of week indicia disposed on the base label. A time of day indicia may be associated with the day of week indicia and may also be disposed on the base label. The patient compliance aid may further comprise a top label covering at least a portion of the base label.

Figure 1:
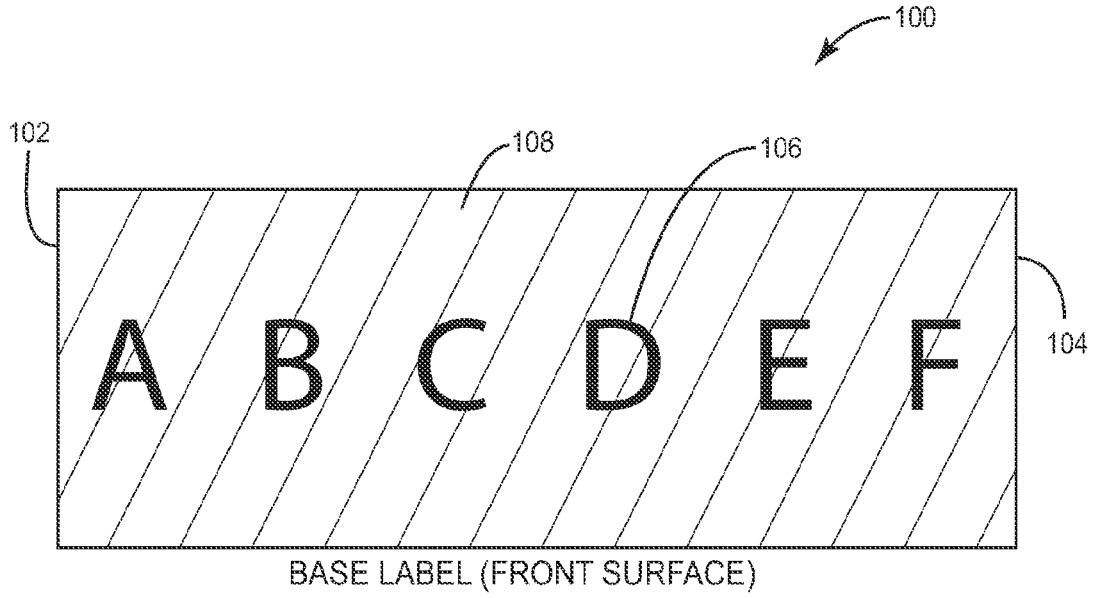
FIG. 1 is a front view of an exemplary label according to various embodiments.

FIG. 1 illustrates various embodiments of a front surface 108 of a base label 100 for an object, such as a medication container, according to various embodiments. The base label 100 comprises a leading edge 102 and a trailing edge 104. While the leading edge 102 is oriented to the left and the trailing edge 104 is oriented to the right as presented in FIG. 1, the orientation of the leading edge 102 and the trailing edge 104 could be reversed depending on which edge is first applied to the object. Both orientations are within the scope of the present disclosure. Base label front surface 108 may comprise writing or other indicia 106 thereon.

As used herein, the leading edge refers to the first edge to be affixed to the object and the trailing edge refers to the second edge to be affixed to the object or the overlapping leading edge. Depending on the orientation of the label and the object when the label is affixed to the object, either edge of the label may be the leading edge. The orientations presented in the figures are for convenience and are not intended to be limiting in any way.

Figure 2:
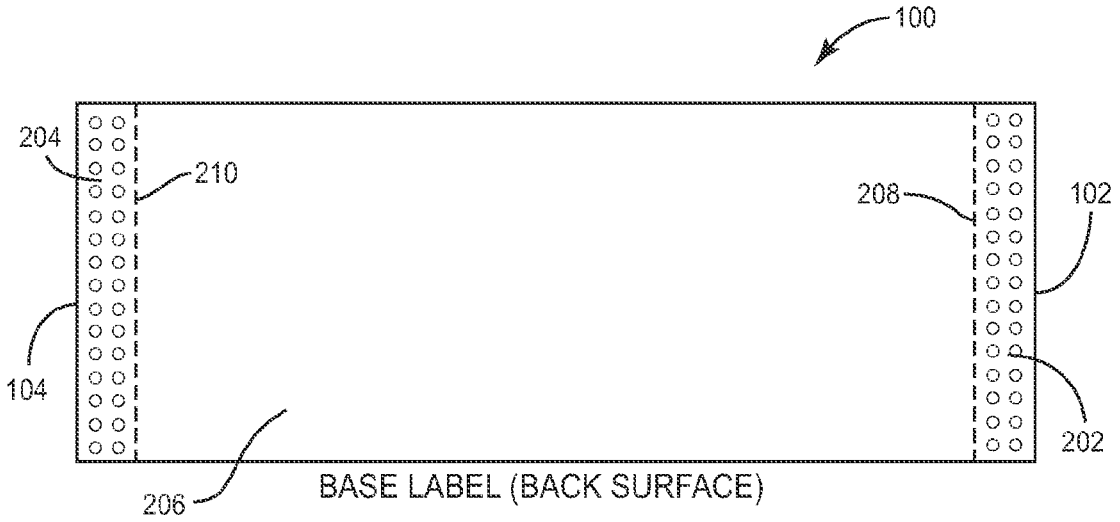
FIG. 2 is a back view of an exemplary label according to various embodiments.

FIG. 2 illustrates various embodiments of a back surface 206 of the base label 100. In various embodiments, the base label back surface 206 comprises two strips of adhesive 202 and 204 on or immediately adjacent to the leading and trailing edges, 102 and 104, respectively. Base label leading edge adhesive 202 may have a boundary 208 defined as its limit on the base label back surface 206. Base label trailing edge adhesive 204 may also have a boundary 210. While FIG. 2 illustrates that the adhesive strips 202 and 204 are generally close to the base label leading and trailing edges 102 and 104, respectively, it is understood that the adhesive strips 202 and 204 may be continuous or discontinuous, and may extend across any portion of the base label back surface 206, including the entire base label back surface 206. In various embodiments, a length of the base label 100 may be selected to be slightly longer than a circumference of the object on which it is placed, such that the trailing edge 104 overlaps the leading edge 102, and the trailing edge 104 is affixed to the leading edge 102. In various embodiments, the length of the base label 100 may be selected to be approximately the same as the circumference of the object on which it is placed, such that the leading edge 102 and the trailing edge 104 do not overlap.

Figure 3:
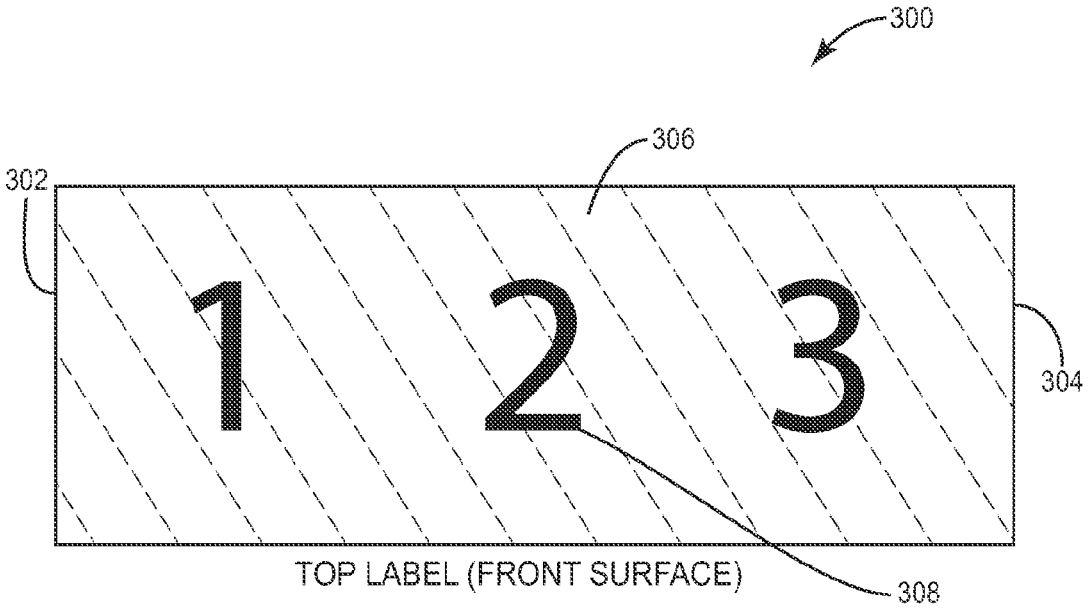
FIG. 3 is a front view of an exemplary label according to various embodiments.

FIG. 3 illustrates various embodiments of a front surface 306 of a top label 300. Top label 300 comprises a leading edge 302 and a trailing edge 304, and indicia 308 may be imprinted on the top label front surface 306.

Figure 4:
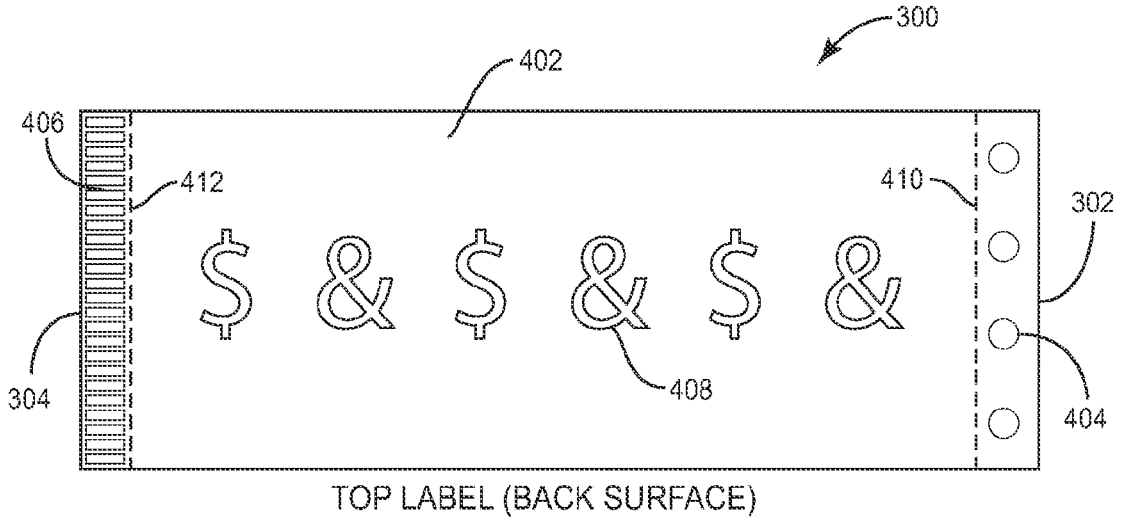
FIG. 4 is a back view of an exemplary label according to various embodiments.

Various embodiments of a back surface 402 of the top label 300 are illustrated in FIG. 4. The top label back surface 402 may comprise various indicia 408 printed thereon, as well as two strips of adhesive 404 and 406 on or immediately adjacent to the leading and trailing edges, 302 and 304, respectively. Top label leading edge adhesive 404 may have a boundary 410 defined as its limit on the top label back surface 402. Top label trailing edge adhesive 406 may also have a boundary 412. While FIG. 4 illustrates that the adhesive strips 404 and 406 are generally close to the top label leading and trailing edges 302 and 304, respectively, it is understood that the adhesive strips 404 and 406 may be continuous or discontinuous, and may extend across any portion of the top label back surface 402, including the entire top label back surface 402. In various embodiments, the adhesive strips 404 and 406 are confined to areas near the leading and trailing edges 302 and 304, respectively, so as not to obscure or interfere with the top label back surface indicia 408.

The base label adhesive 202, 204 and the top label adhesive 404, 406 may be applied in a variety of patterns as can be appreciated by one skilled in the art. The adhesive 202, 204, 404, 406 may be applied in strips, dots, droplets, circles, rectangles, squares, triangles, lines, and the like, as well as combinations of patterns.

A length of the top label 300 may be selected to be slightly longer than a circumference of the object on which it is placed, such that the top label trailing edge 304 overlaps the top label leading edge 302, and the top label trailing edge 304 is affixed to the top label leading edge 302. In various embodiments, the length of the top label 300 may be selected to be approximately the same as the circumference of the object on which it is placed, such that both the leading edge 302 and the trailing edge 304 do not overlap and are affixed to the base label front surface 108.

Figure 5A:
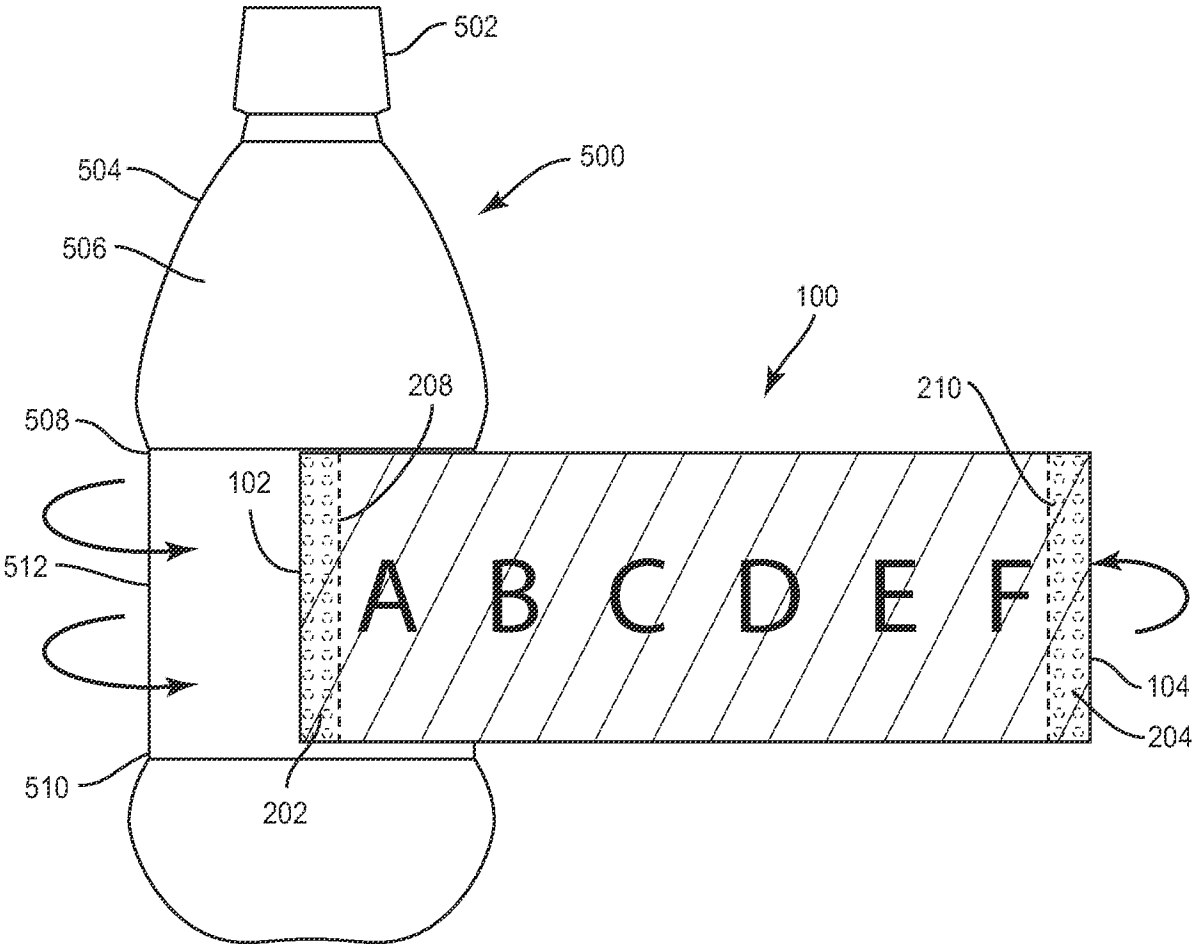
FIG. 5A illustrates a leading edge of an exemplary label affixed to a container according to various embodiments.

FIG. 5A illustrates the application of the base label 100 to an exemplary container 500 according to various embodiments. The container 500 may be a glass or plastic bottle, or other type of container, such as a metal can or a cardboard receptacle. The container may be round, rectangular, square, or any other shape known in the art. The term "container" is used here for convenience to describe exemplary embodiments. It is understood that the container may be any object, including non-containers. Container 500 may comprise a cap 502 removably secured to a body 504. Various embodiments of the body 504 may have an exterior surface 506 that comprises a upper label panel 508, a lower label panel 510, and a recessed surface 512 interposed between the upper label panel 508 and the lower label panel 510. As discussed below, the base label 100 may be applied to the container 500 at the recessed surface 512 between the upper label panel 508 and the lower label panel 510.

In various embodiments, the top label 300 may be rotatable about the base label 100, as discussed below. In these embodiments, the upper label panel 508 and lower label panel 510 may function to restrict upward and downward movement of the top label 300 in relation to the container 500, such that the top label 300 generally remains in a position covering at least a portion of the base label 100.

Figure 5B:
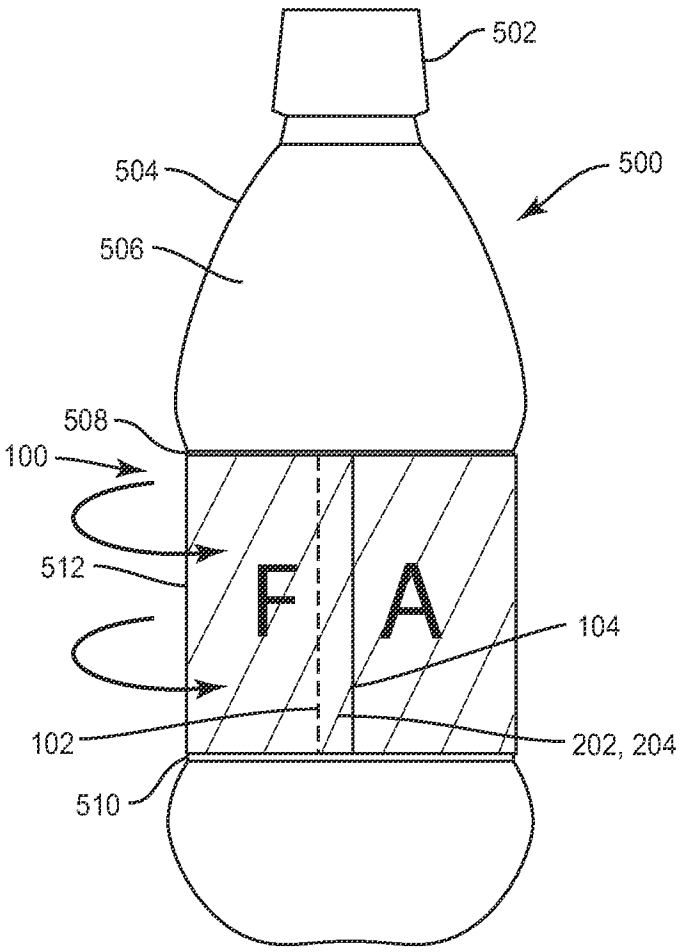
FIG. 5B illustrates an exemplary label secured about a container according to various embodiments.

FIG. 5B illustrates the container 500 with the base label 100 affixed to the container 500. Initially, as illustrated in FIG. 5A, base label leading edge 102 is placed in contact with the recessed surface 512 of the container 500 and affixed to the container 500 by the leading edge adhesive strip 202. With relative motion between the container 500 and the base label 100, the base label 100 may be wrapped around the container 500 with the base label trailing edge 104 now overlapping the base label leading edge 102, such that the leading edge adhesive strip 202 holds the base label leading edge 102 to the container 500 while the trailing edge adhesive strip 204 holds the base label trailing edge 104 to the overlapped base label leading edge 102.

Figure 6:
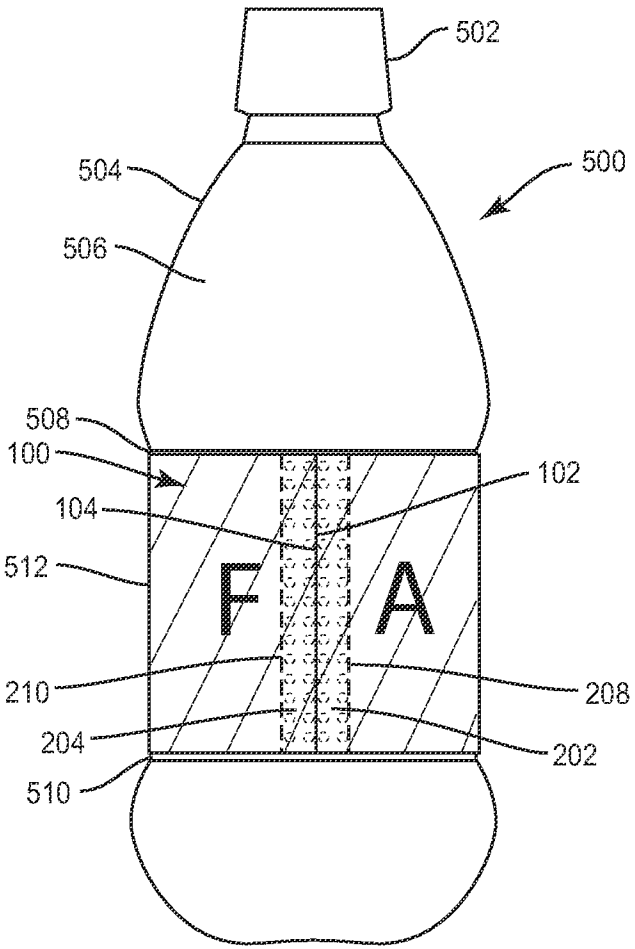
FIG. 6 illustrates an exemplary label secured about a container according to various embodiments.
Figure 7:
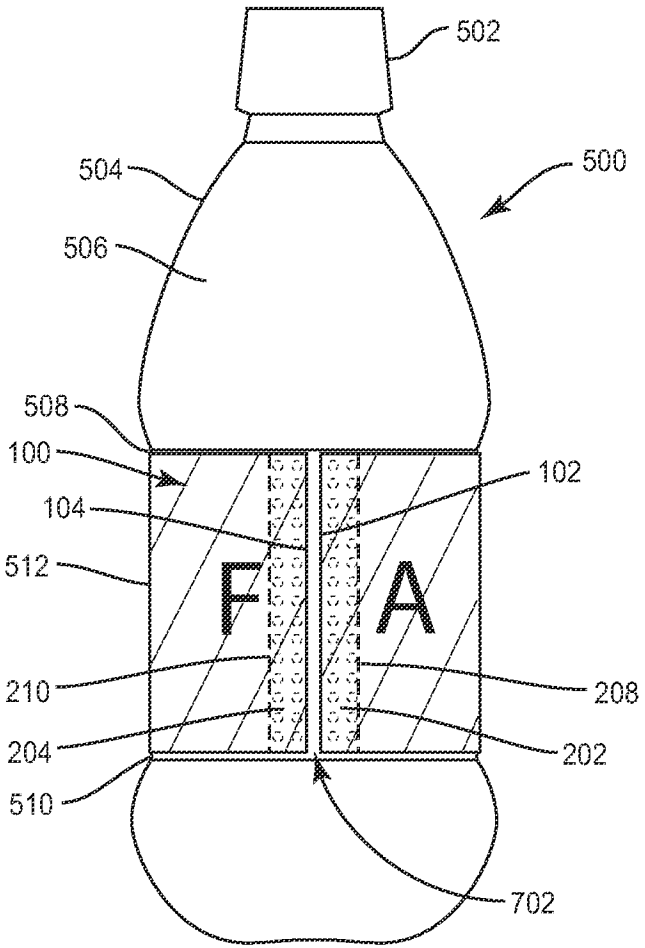
FIG. 7 illustrates an exemplary base label secured about a container according to various embodiments.

In various embodiments, as illustrated in FIG. 6, the length of the base label 100 may be substantially the same as a circumference of the recessed surface 512 of the container 500, which may allow the base label leading edge 102 and base label trailing edge 104 to abut rather than overlap. However, it is also possible that the length of the base label 100 may be shorter than the circumference of the recessed surface 512, resulting in a gap 702 between the base label leading edge 102 and the base label trailing edge 104 when the base label 100 is affixed to the recessed surface, as illustrated in FIG. 7. In both of these instances, the base label trailing edge adhesive strip 204 may adhere to the recessed surface 512 of the container 500, rather than the base label leading edge 102.

In various embodiments, the base label adhesive strips 202, 204 may comprise a permanent adhesive. In general, a permanent adhesive is one that does not readily release from a surface to which it adheres after the adhesive dries or cures. Using the base label 100 as an example, the permanent adhesive 202, 204 will tend not to release from the recessed surface 512, nor will it tend to release the base label leading edge 102 or trailing edge 104 once dried or cured. In order to remove the base label from the recessed surface 512, the base label 100 may have to be torn from the adhesive, or the adhesive strips 202, 204 may have to be fractured, which may leave some of the adhesive on the recessed surface 512 and some of the adhesive on the base label leading edge 102 or trailing edge 104. Once the surfaces affixed with the permanent adhesive are separated, they may not be reattached.

Figure 8:
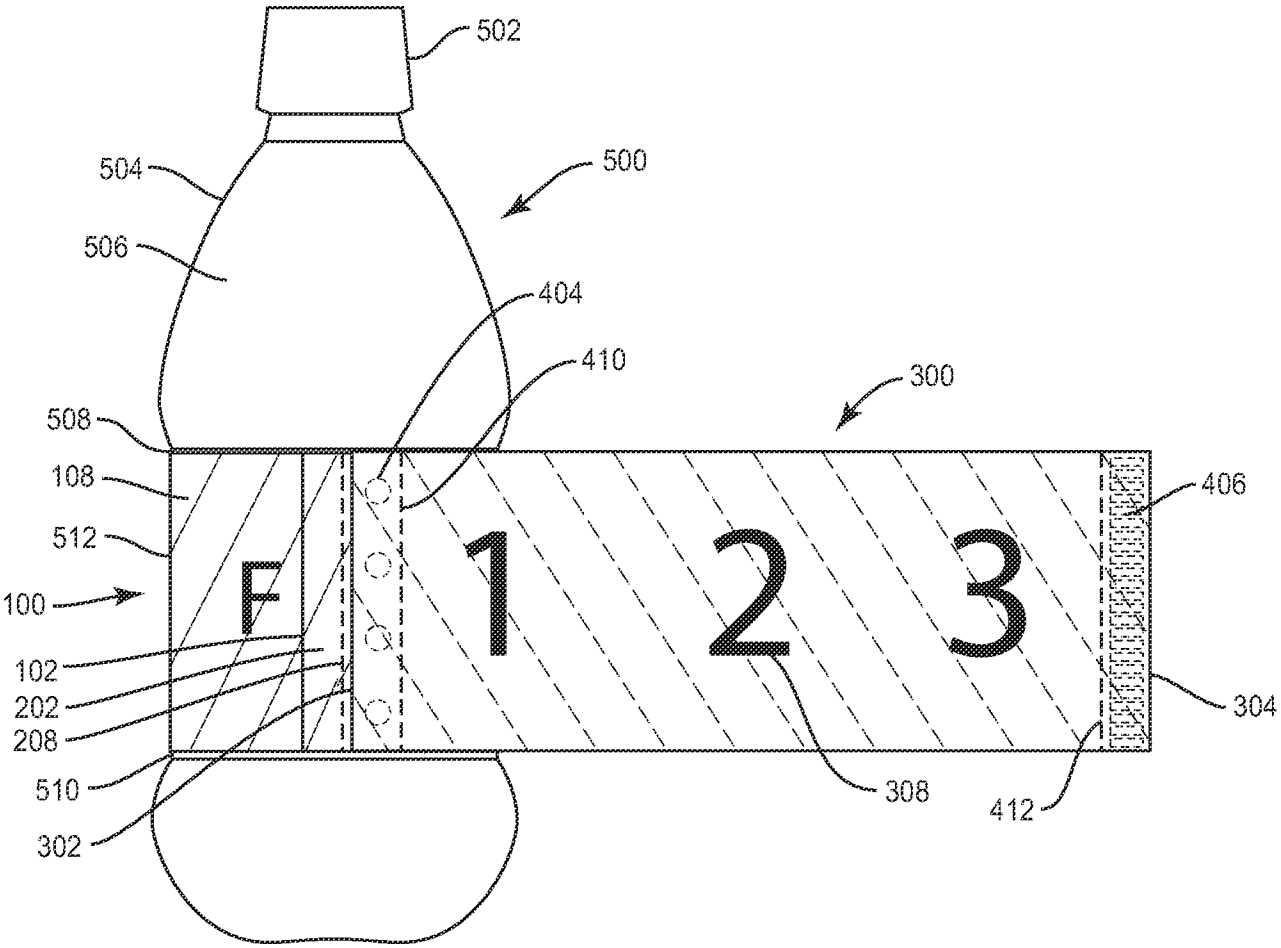
FIG. 8 illustrates a leading edge of an exemplary top label affixed to an exemplary base label according to various embodiments.

In FIG. 8, the base label 100 is already affixed to the recessed surface 512 of the container 500, and the application of the top label 300 over the base label 100 is illustrated according to various embodiments. The top label leading edge 302 may be placed in contact with any portion of the base label front surface 108 and affixed to the base label front surface 108 by the top label leading edge adhesive strip 404. With relative motion between the container 500 and the top label 300, the top label 300 may be wrapped around the container 500 with the top label trailing edge 304 now overlapping the top label leading edge 302 such that the top label leading edge adhesive strip 404 holds the top label leading edge 302 to the base label 100 while the top label trailing edge adhesive strip 406 holds the top label trailing edge 304 to the overlapped top label leading edge 302.

Figure 9:
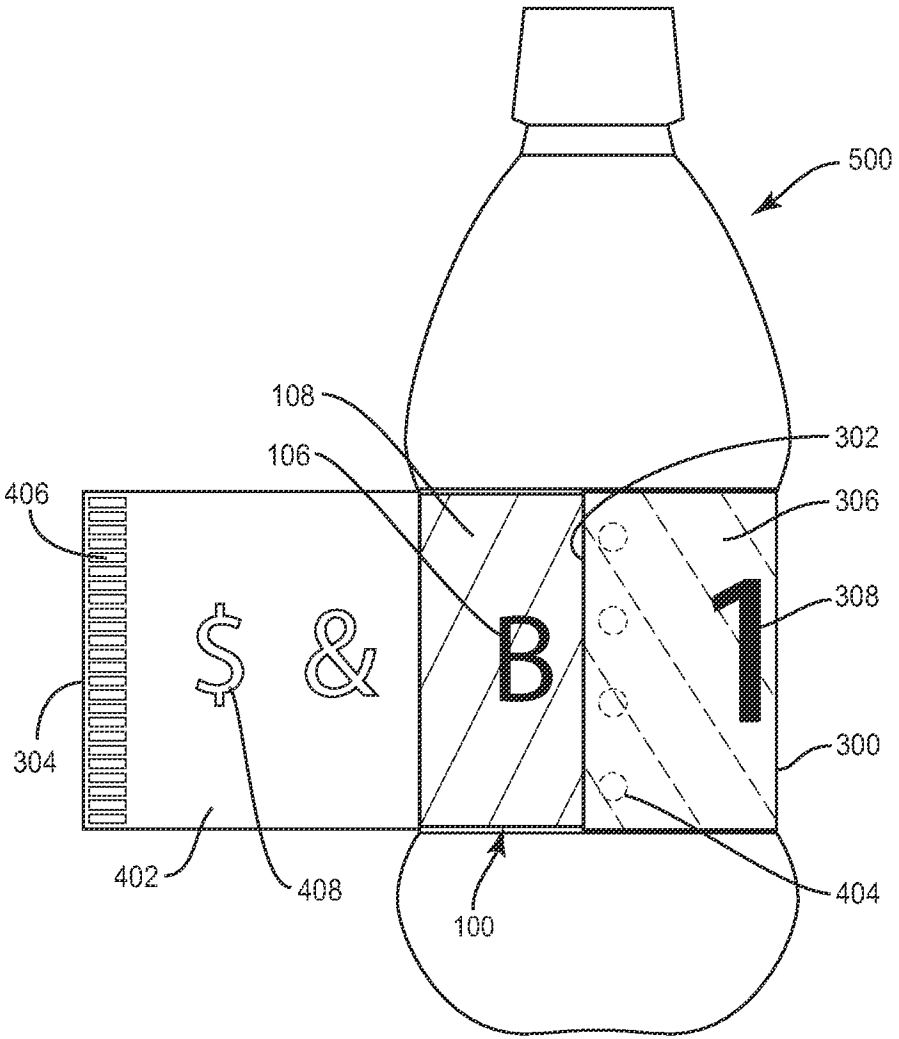
FIG. 9 illustrates an exemplary top label affixed to an exemplary base label and partially wrapped about a container according to various embodiments.

FIG. 9 illustrates the operation of the base label 100 and the top label 300 according to various embodiments. Beginning with the container 500 with the base label 100 and the top label 300 in place as shown, for example, in FIG. 6, the top label trailing edge 304 may be detached from the top label leading edge 302 and at least partially peeled back as shown in FIG. 9. The combination of the base label 100 and the top label 300 in this configuration increases the amount of surface area available for viewing by a consumer or user of the container 500. Prior to detaching the top label trailing edge 304, the consumer may view the top label front surface 306. Upon detaching the top label trailing edge 304, the consumer may now view the top label back surface 402 and the base label front surface 108, in addition to the top label front surface 306.

One of at least three types of adhesive may be used for the top label leading edge adhesive 404. A first type of adhesive is the permanent adhesive as described above for the base label 100. When a permanent adhesive is used for the top label leading edge adhesive 404, the top label leading edge 302 generally cannot be detached without inflicting damage to one or both of the top label 300 or the base label 100. This may be desirable for various embodiments where the top label 300 is not intended to be removed from the container 500.

A second type of adhesive that may be used for the top label leading edge adhesive 404 is a releasable adhesive. A releasable adhesive is one that will release from a surface to which it is attached once a sufficient mechanical force is applied. A releasable adhesive may be used, for example, when the top label back surface 402 comprises a coupon for a subsequent purchase of a product. The releasable adhesive may allow the consumer to easily remove the top label 300 for later use. In various embodiments, the releasable adhesive may be a breakaway adhesive. A breakaway adhesive may have limited ability to withstand shear stresses. Shear stresses may cause the adhesive bond created between the label (e.g., top label 300) and the surface to which it is affixed (e.g., the base label 100 or container 500) to fail along the adhesive. In general, a releasable or breakaway adhesive may not re-attach to a surface once removed.

A third type of adhesive that may be used for the top label leading edge adhesive 404 is a resealable adhesive. A resealable adhesive may release from a surface to which it is attached once a sufficient mechanical force is applied, similar to the releasable adhesive described above. However, the resealable adhesive may be re-attached to a surface by applying pressure. A resealable adhesive may be desirable when the top label back surface 402 or the base label front surface 108 comprise information that may be needed only on occasion. Thus, the consumer or user may detach the top label 300 when the information is needed, then re-attach the top label 300.

In various embodiments, the top label trailing edge adhesive 406 may be a releasable adhesive or a resealable adhesive, depending on the intended use of the top label 300. As described above, if the surfaces 108, 402 comprise information that is intended to stay with the container, the top label trailing edge adhesive 406 may be a resealable adhesive. In contrast, if the top label 300 is intended to be removed from the container 500, a releasable adhesive may be desirable.

Figure 10:
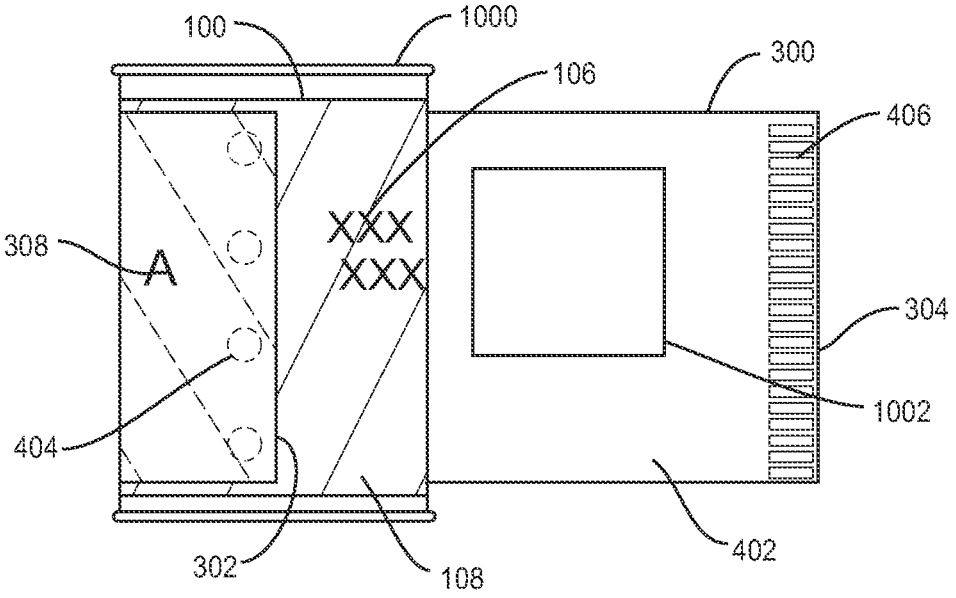
FIG. 10 illustrates an exemplary top label with a window affixed to an exemplary base label and partially wrapped about a container according to various embodiments.

FIG. 10 illustrates various embodiments of the top label 300 comprising a window 1002. The window 1002 may comprise a void in the top label 300 such that a portion of the base label 100 may be visible through the window. In various embodiments, the window 1002 may have a transparent covering (not shown). In various other embodiments, the window may comprise a transparent section of the top label 300 itself rather than a void. FIG. 10 illustrates the top label 300 partially wrapped about a container 1000, and base label 100 already in place on the container 1000. As shown, the top label leading edge adhesive 404 maintains the top label 300 coupled to the base label 100. The top label 300 may then be moved from the position illustrated in FIG. 10 to the position illustrated in FIG. 11 to secure the top label 300 about the container 1000. Top label trailing edge adhesive 406 may couple to the top label leading edge 302 if the top label leading edge 302 and trailing edge 304 overlap; otherwise, the top label trailing edge adhesive 406 may be coupled to the base label front surface 108.

Figure 11:
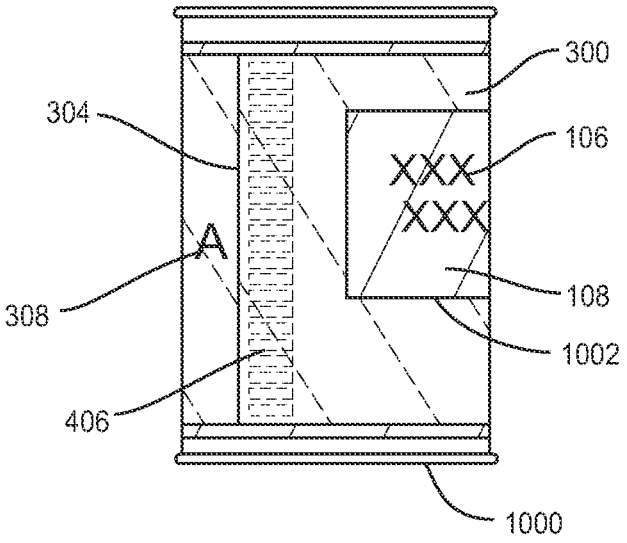
FIG. 11 illustrates an exemplary top label with a window secured about a container and a portion of a base label visible through the window according to various embodiments.

Once the top label 300 is in position on the container 1000 as illustrated in FIG. 11, at least a portion of the base label front surface indicia 106 may be visible through the window 1002. This may allow viewing of a first portion of the base label 100 without removing the top label 300. In various embodiments, the top label leading edge adhesive 404 may be a breakaway adhesive. Rotation of the top label 300 relative to the base label 100 may exert shear stresses on the breakaway adhesive, causing the adhesive bond affixing the top label leading edge 302 to the base label 100 to fail. The top label 300 may then be freely rotatable about the base label 100, and a second portion of the base label 100 may be visible when the top label 300 is rotated to a second position. The window 1002 may be rectangular as illustrated in FIGS. 10 and 11, or any other shape as needed for a particular application. For example, the window 1002 may be a slit that reveals an alphanumeric string on the base label 100. In various embodiments, the top label 300 may comprise more than one window 1002. Various embodiments in which the top label trailing edge adhesive 406 is a resealable or releasable adhesive may allow the top label 300 to be peeled back to reveal the top label back surface 402 and essentially the entire base label front surface 108 or to be removed from the container 1000, in addition to being rotatable.

One skilled in the art will readily recognize that labels may be applied to containers using a variety of methods and that there may be a variety of single-label and multi-label systems other than those described above. Any such application methods or label systems may be used with the present disclosure. The above descriptions are exemplary and not to be construed as limiting in any way. Examples of other application methods and label systems may be disclosed in U.S. Pat. Nos. 5,884,421, 6,086,697, 6,237,269, 6,402,872, 6,631,578, 6,649,007, 7,087,298, and 7,172,668.

Figure 12A:
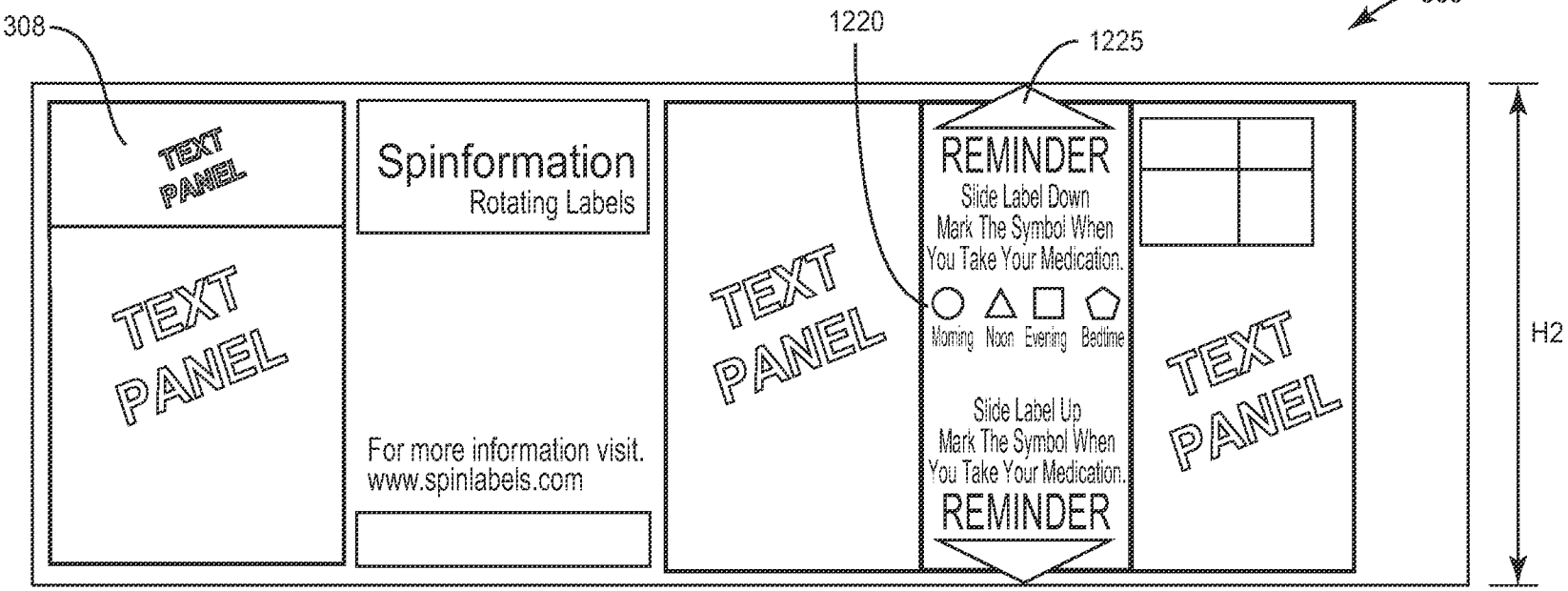
FIG. 12A is a front view of a top label according to various embodiments.
Figure 12B:
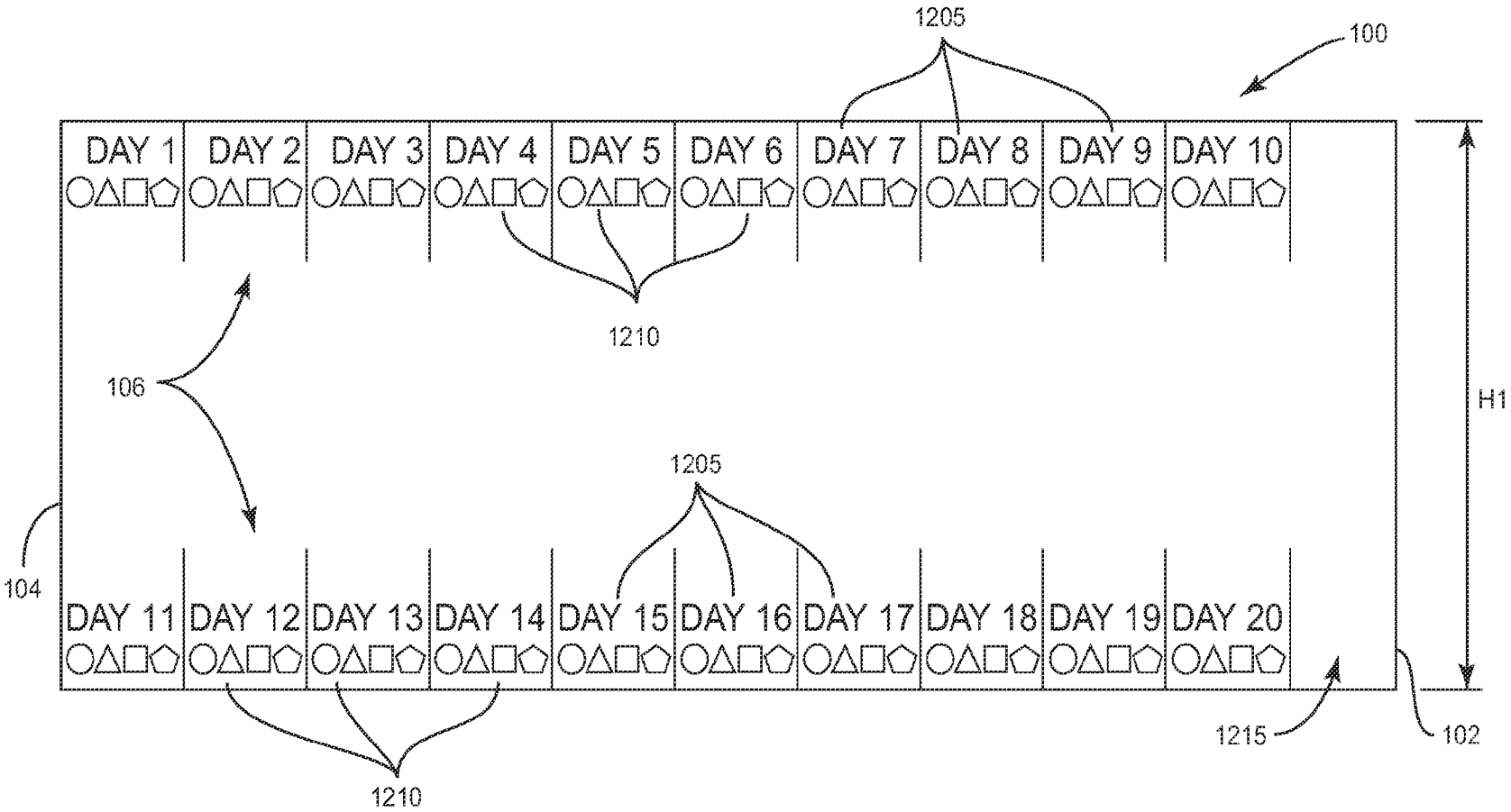
FIG. 12B is a front view of a base label according to various embodiments.

FIG. 12A illustrates various embodiments of a top label 300 and FIG. 12B illustrates various embodiments of a base label 100 comprising a patient compliance aid that may be used, for example, on a medication container. The base label indicia 106 may comprise a plurality of indicia corresponding to days of the week indicia 1205. As illustrated in FIG. 12B, the day of week indicia 1205 range from Day 1 to Day 20.

Various embodiments of the present invention may comprise a patient compliance aid that may be used, for example, on a medication container 1501. The patient compliance aid may comprise the base label 100 and the top label 300. The base label 100 may contain indicia 106 selected to correspond to a prescribed number of days and frequency per day the medication should be consumed. FIG. 12B illustrates exemplary day of week indicia 1205 indicating "Day 1," or the first day the medication should be consumed, through "Day 20," or the last day the medication should be consumed. Alternatively, the day of week indicia 1205 may comprise Monday, Tuesday, Wednesday, etc., repeating for as many days as necessary to consume the medication. Various embodiments of the day of week indicia 1205 may also comprise days of the month, such as March 1, March 2, March 3, etc. Those skilled in the art will recognize that the day of week indicia 1205 may comprise a variety of indicators, and that the day of week indicia 1205 may be customized for each medication container. For example, the day of week indicia 1205 may correspond to the number of days the medication should be consumed (for example, 20 days as illustrated in FIG. 12B), or the days of the month the medication should be consumed (for example, the day of week indicia 1205 may run from March 1 to March 20 for the same 20-day period).

In various embodiments, the base label indicia 106 may comprise time of day indicia 1210, either in conjunction with the day of week indicia 1205 as illustrated in FIG. 12B, or independently. The time of day indicia 1210 may indicate the time of day the medication should be consumed. The time of day indicia 1210 may comprise a variety of symbols as illustrated in FIG. 12B. For example, a circle may indicate that a dose of the medication should be consumed in the morning; a triangle may indicate that a dose should be consumed at noon; a square may indicate that a dose should be consumed in the evening; and a pentagon may indicate that a dose should be consumed at bedtime. In various embodiments, the symbols may also comprise a letter within the symbol to further indicate the time of day the medicine should be consumed. For example, the letter "M" may be placed within the circle to indicate morning, the letter "N" may be placed within the triangle to indicate noon, and so on. Alternatively, all the symbols may be the same (such as circles or ovals) with the appropriate letter within each symbol.

The day of week indicia 1205 and the time of day indicia 1210 may be placed along both a top edge and a bottom edge opposite the top edge of the base label as illustrated in FIG. 12B. In various embodiments, the indicia 1205, 1210 may be placed along one of the top edge or the bottom edge of the base label 100.

Figure 13:
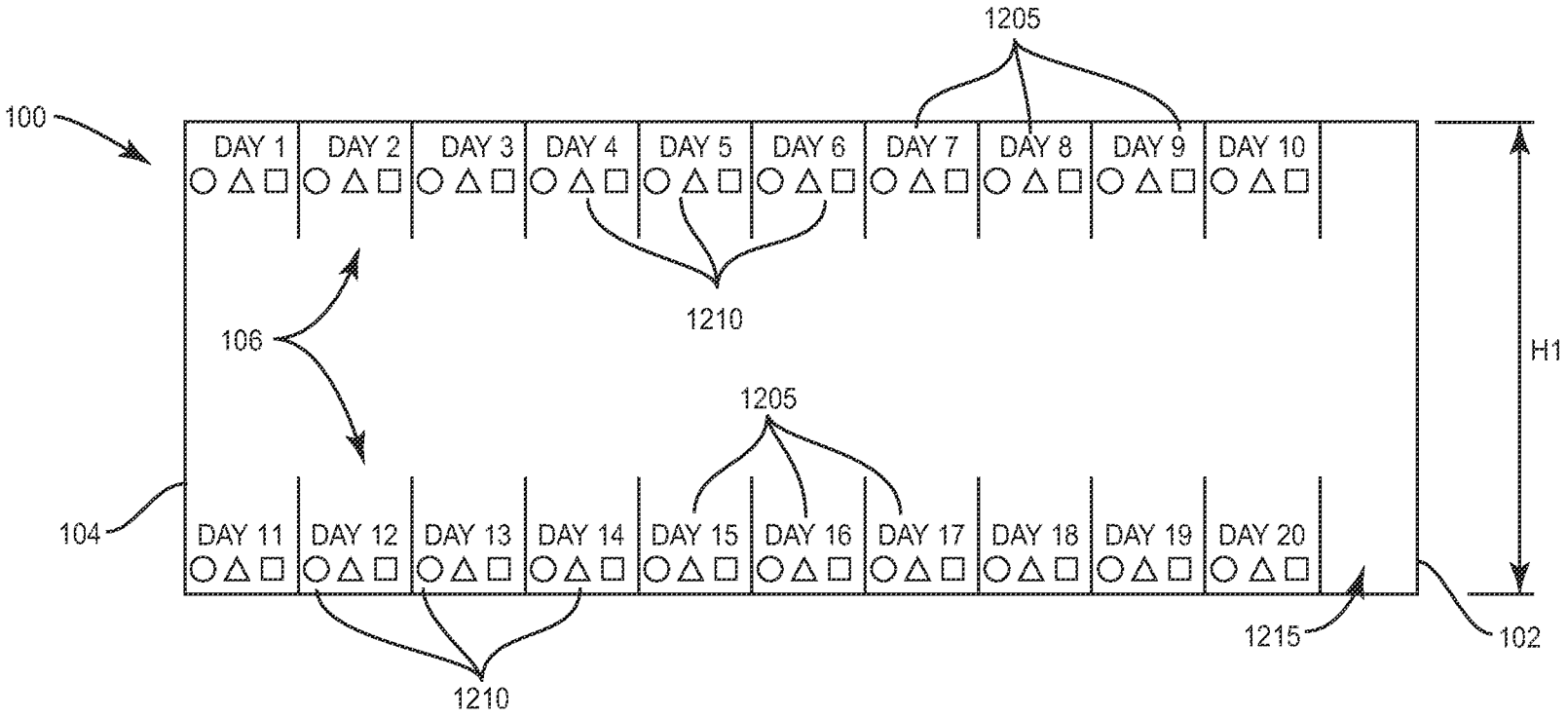
FIG. 13 is a front view of a base label according to various embodiments.
Figure 14:
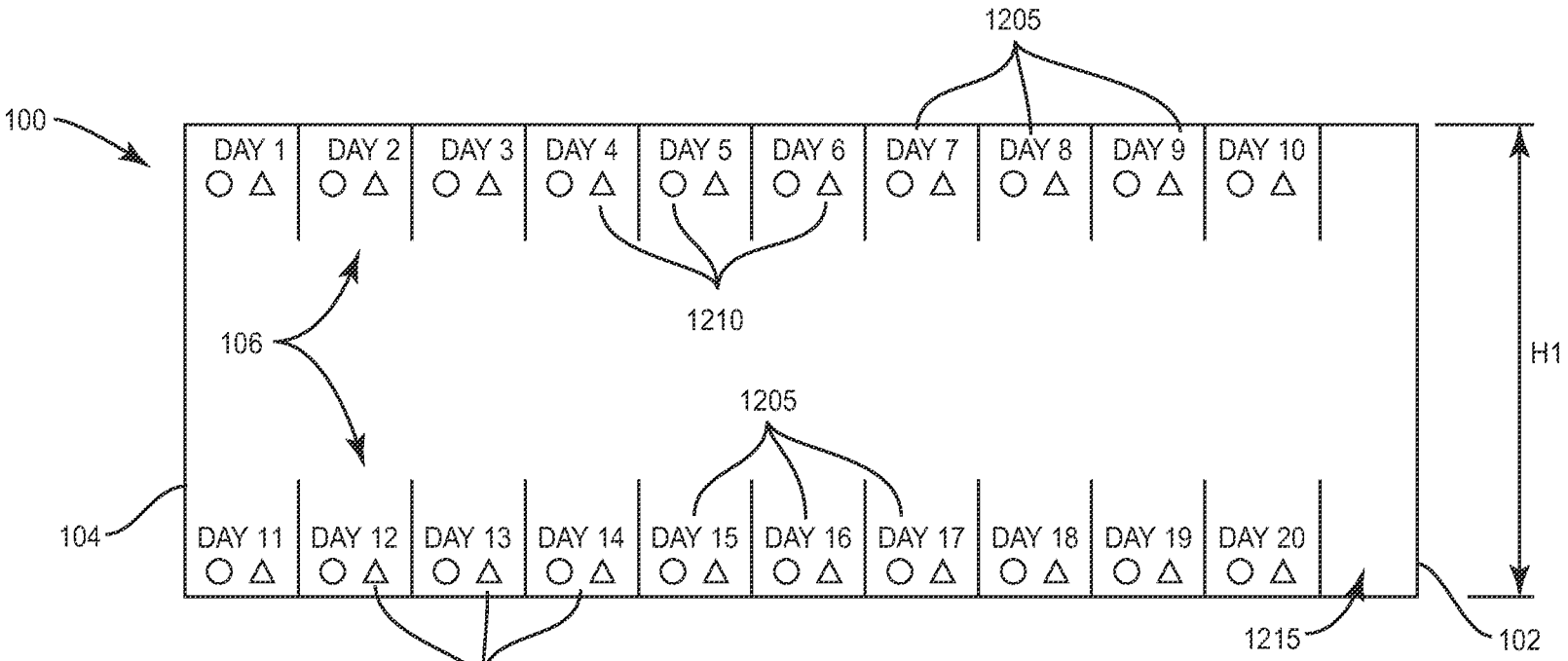
FIG. 14 is a front view of a base label according to various embodiments.

One skilled in the art will recognize that any number of symbols may comprise the time of day indicia 1210. For example, FIG. 13 illustrates three symbols that may correspond to consuming the medication in the morning, at noon, and in the evening. Similarly, FIG. 14 illustrates time of day indicia 1210 comprising two symbols, which may indicate that the medication should be consumed in the morning and the evening. Other symbols, letters, numbers, and like may be used as is known in the art.

Returning to FIG. 12B, the base label 100 may have a blank portion 1215 along the leading edge 102 that is essentially void of any indicia 106. As described previously, the trailing edge 104 may overlap the leading edge 102 when the base label 100 is applied to the container. The blank portion 1215 provides a space for attachment of the trailing edge without obscuring any of the indicia 106.

The patient compliance aid may further comprise top label 300 according to various embodiments. Top label 300 may comprise indicia 308 relaying medication-related information, patient-related information, medical-provider related information, and the like. Additionally, the top label may comprise a legend 1220 identifying the time of day indicia 1210, and reminder indicia 1225, which may be used to indicate the next time of day for consumption of the medication as described further below.

The top label 300 may have a height H2 and base label 100 may have a height H1 as illustrated in FIGS. 12A and 12B, respectively. In various embodiments, the height H2 of the top label 300 may be selected to be less than the height H1 of the base label 100, such that either the indicia 1205, 1210 along the top edge of the base label 100 are visible, or the indicia 1205, 1210 along the bottom edge are visible, depending on the placement of the top label 300.

Figure 15A:
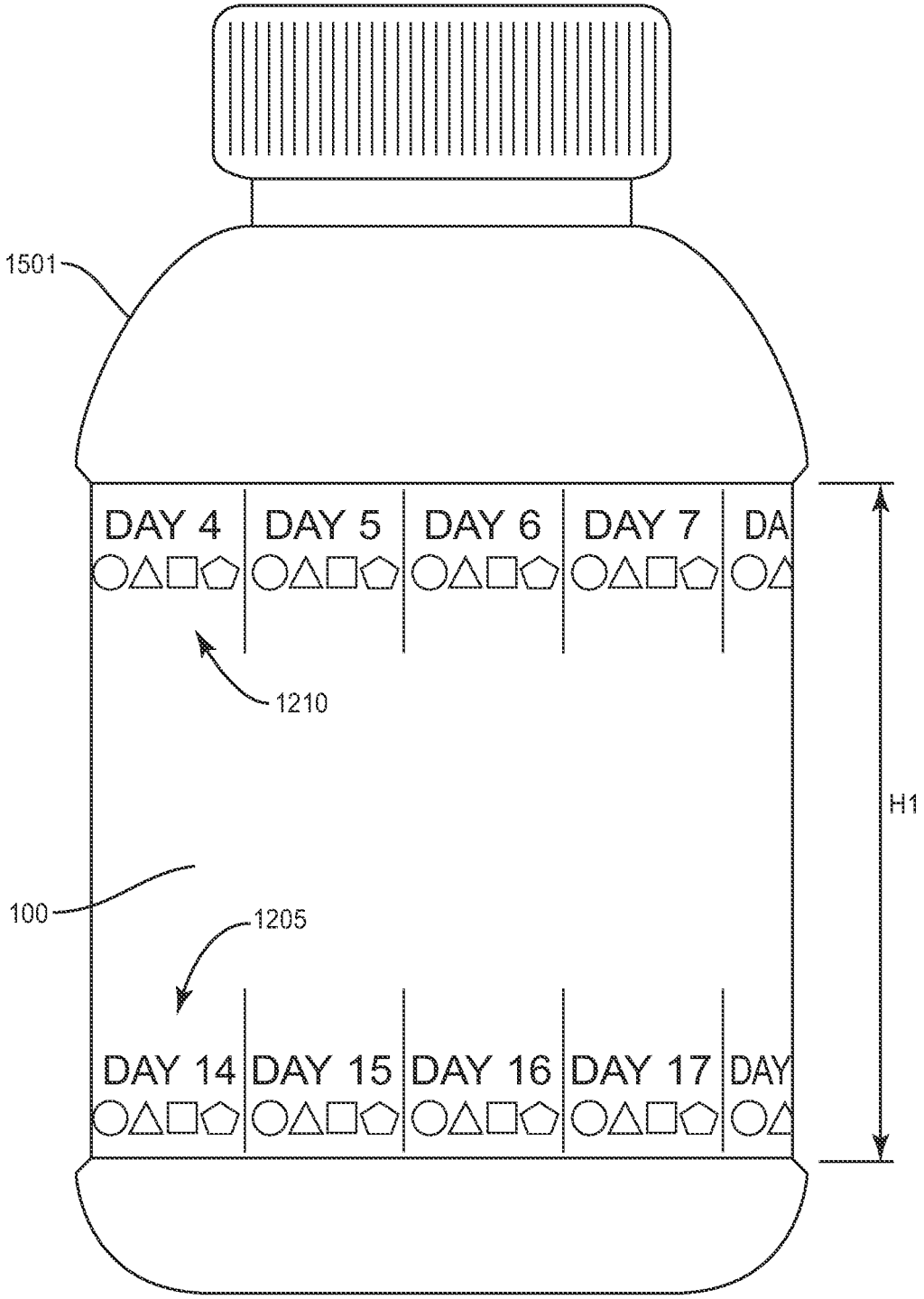
FIG. 15A illustrates an exemplary base label secured about a container according to various embodiments.
Figure 15B:
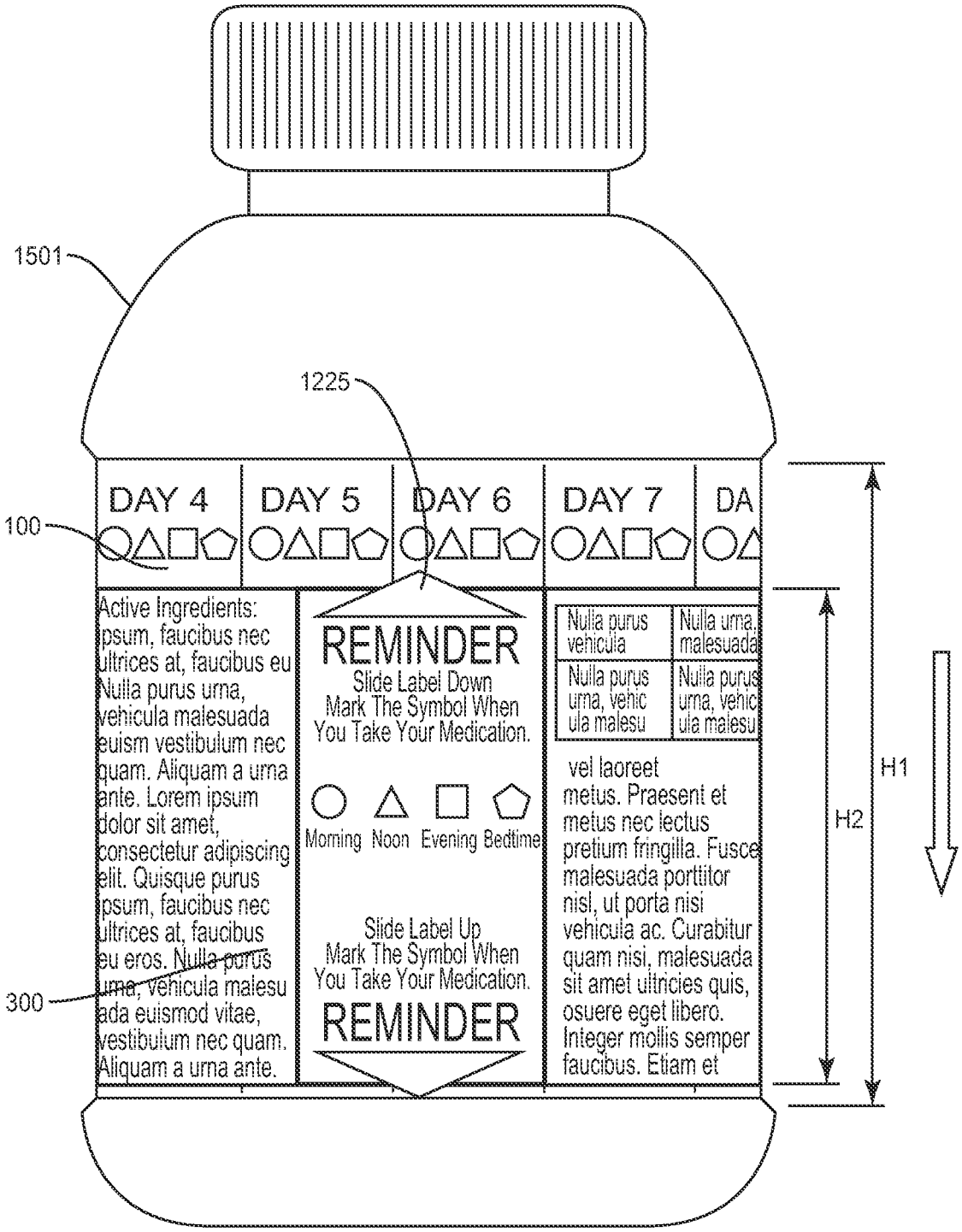
FIG. 15B illustrates an exemplary base label and top label secured about a container according to various embodiments.
Figure 15C:
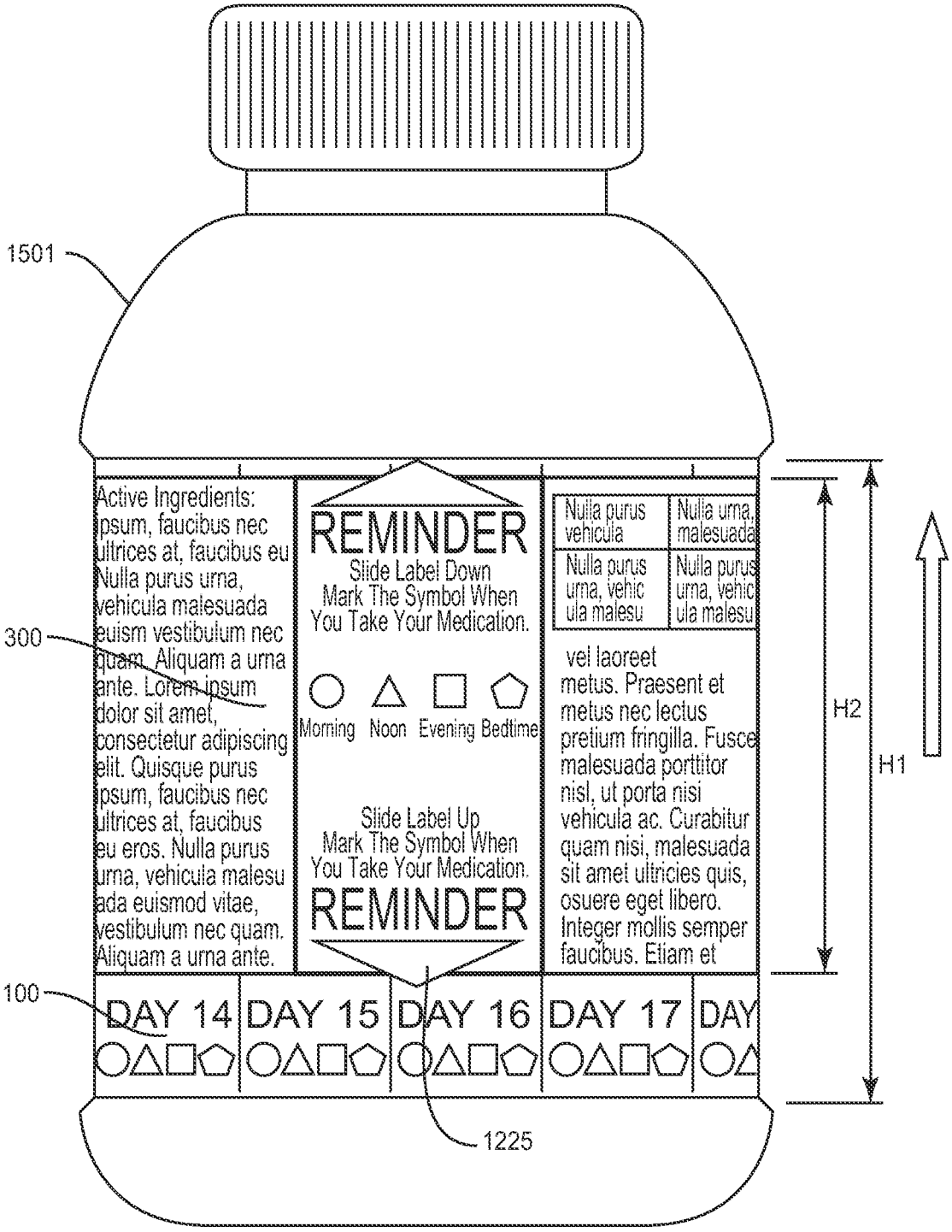
FIG. 15C illustrates an exemplary base label and top label secured about a container according to various embodiments.

FIGS. 15A-15C illustrate the base label 100 and top label 300 on a medication container 1501 according to various embodiments. In FIG. 15A, the base label 100 is positioned on the medication container 1501, and the base label 100 comprises indicia 1205, 1210 along both the top edge and the bottom edge. FIG. 15B illustrates the top label 300 in place over the base label 100. As described previously, the top label 300 may be applied such that the top label 300 is rotatable around a circumference of the medication container 1501 and slidable up and down along at least a portion of a length of the medication container 1501. In FIG. 15B, the top label 300 has been slid downward in the direction of the arrow revealing the indicia 1205, 1210 along the top edge of the base label 100 and covering the indicia 1205, 1210 along the bottom edge of the base label 100. Similarly, FIG. 15C illustrates the top label 300 slid upwards in the direction of the arrow, thus revealing the indicia 1205, 1210 along the bottom edge of the base label 100 and covering the indicia 1205, 1210 along the top edge of the base label 100.

In FIG. 15B, the top label 300 may be rotated such that the reminder indicia 1225 lines up with the time of day indicia 1210 corresponding to the time the next dose should be consumed. As illustrated in FIG. 15B, the reminder indicia 1225 indicates that the next dose should be consumed in the morning of Day 6. Similarly, when the top label 300 is slid upward, as illustrated in FIG. 15C, the reminder indicia 1225 may be used to indicate the appropriate time of day indicia 1210 along the bottom edge of the base label 100. After each dose is consumed, the patient may rotate the top label 300 so that the reminder indicia 1225 lines up with the next symbol of the time of day indicia 1210.

Figure 16:
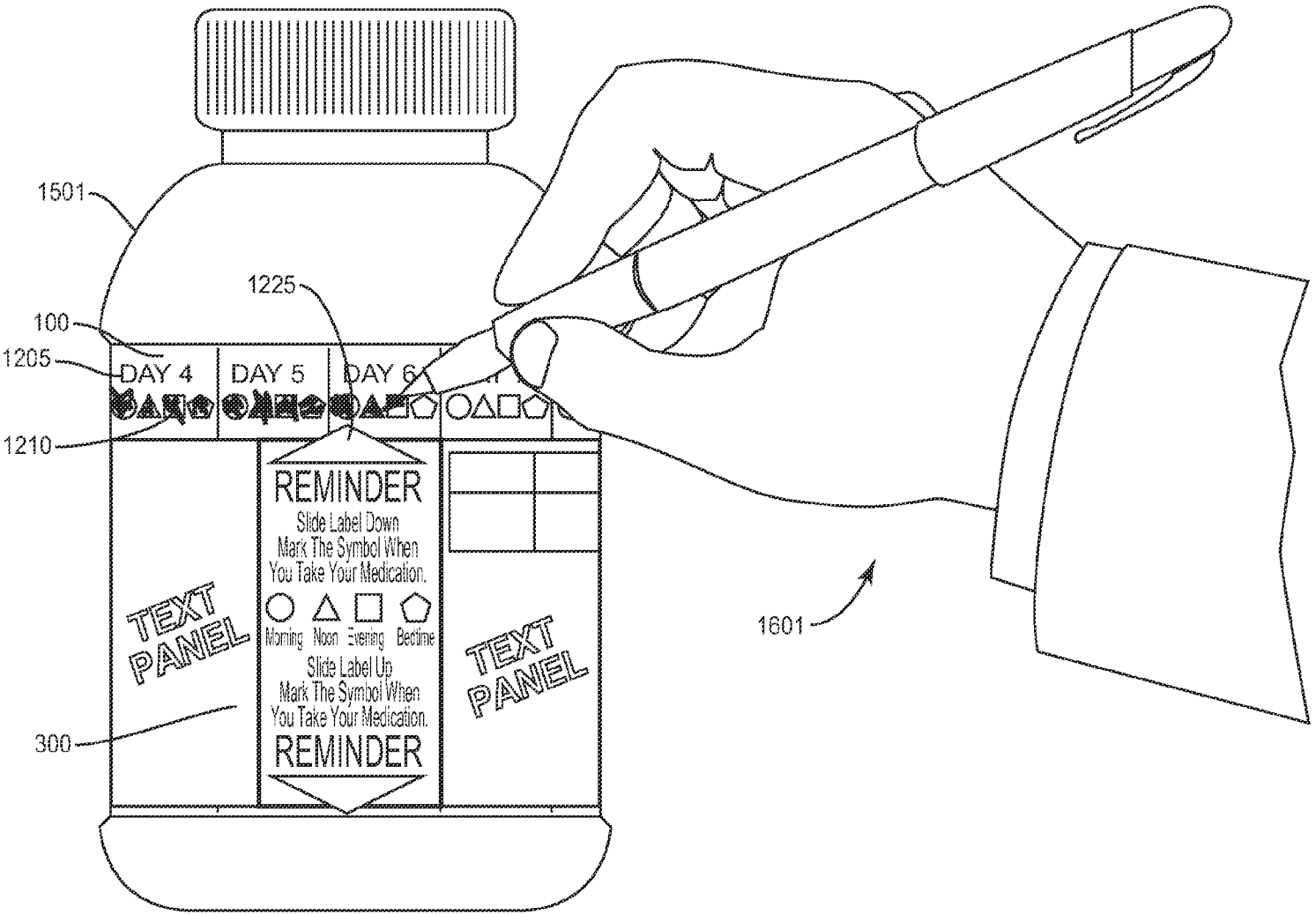
FIG. 16 illustrates a markable base label secured about a container according to various embodiments.

The day of week indicia 1205 and the time of day indicia 1210 may be markable with a writing instrument, such as a pen or pencil. FIG. 16 illustrates various embodiments in which the time of day indicia 1210 are markable with a writing instrument. The patient may mark the appropriate symbol of the time of day indicia 1210 after taking each dose of the medication. In the example of FIG. 16, the patient has just consumed the evening dose on Day 6 and is marking the square symbol corresponding to the evening dose with a writing instrument 1601. The patient may then rotate the top label 300 until the reminder indicia 1225 lines up with the symbol for the Day 6 bedtime dose.

Figure 17:
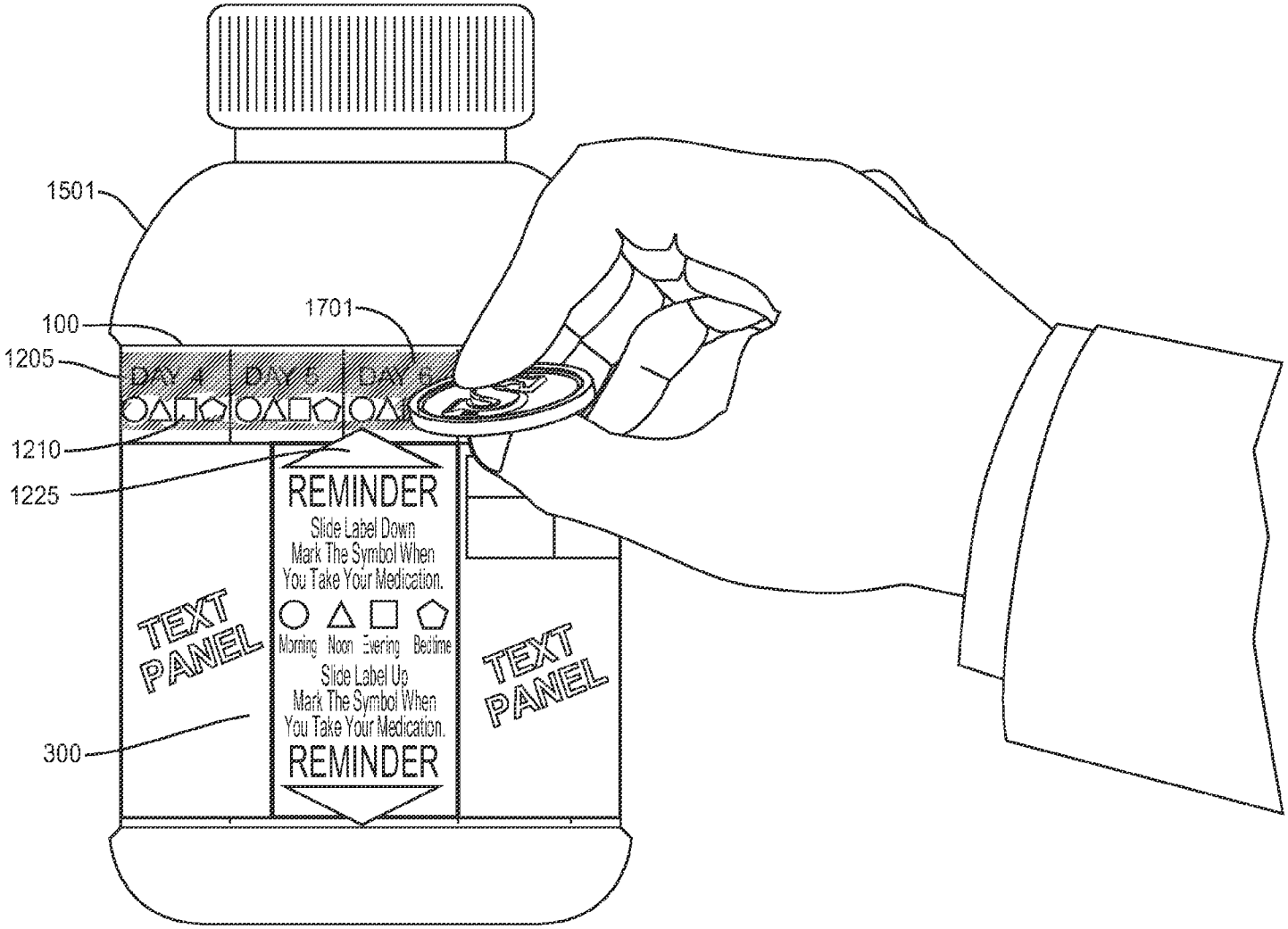
FIG. 17 illustrates a scratchable base label secured about a container according to various embodiments.

As illustrated in FIG. 17, the indicia 1205, 1210 may comprise, or alternatively may be coated with, a scratchable substance 1701. In various embodiments, the patient may scratch off the scratchable substance 1701 at the symbol corresponding to the day of week indicia 1205 or time of day indicia 1210 corresponding to a dose consumed by the patient. In various embodiments, the scratchable substance 1701 may not be a coating, but rather may be the base label 100 itself. For example, the base label 100, or a portion of the base label 100 where the indicia 1205, 1210 are located, may comprise the scratchable substance 1701 that darkens when scratched. In the example of FIG. 17, the patient has scratched off the scratchable substance 1701 at the time of day indicia 1210 corresponding to the Day 6 noon dose.

Figure 18A:
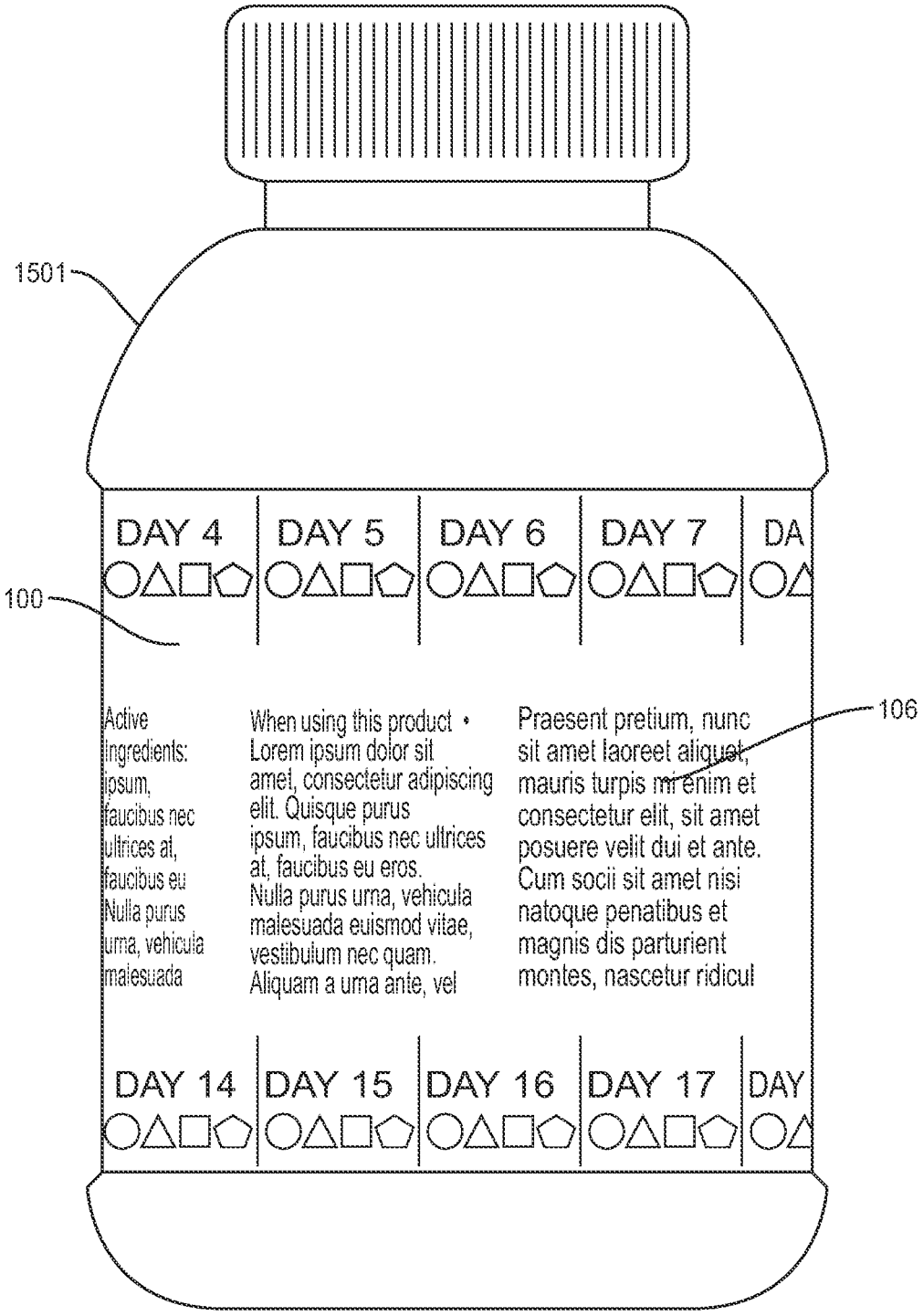
FIG. 18A illustrates an exemplary base label secured about a container according to various embodiments.
Figure 18B:
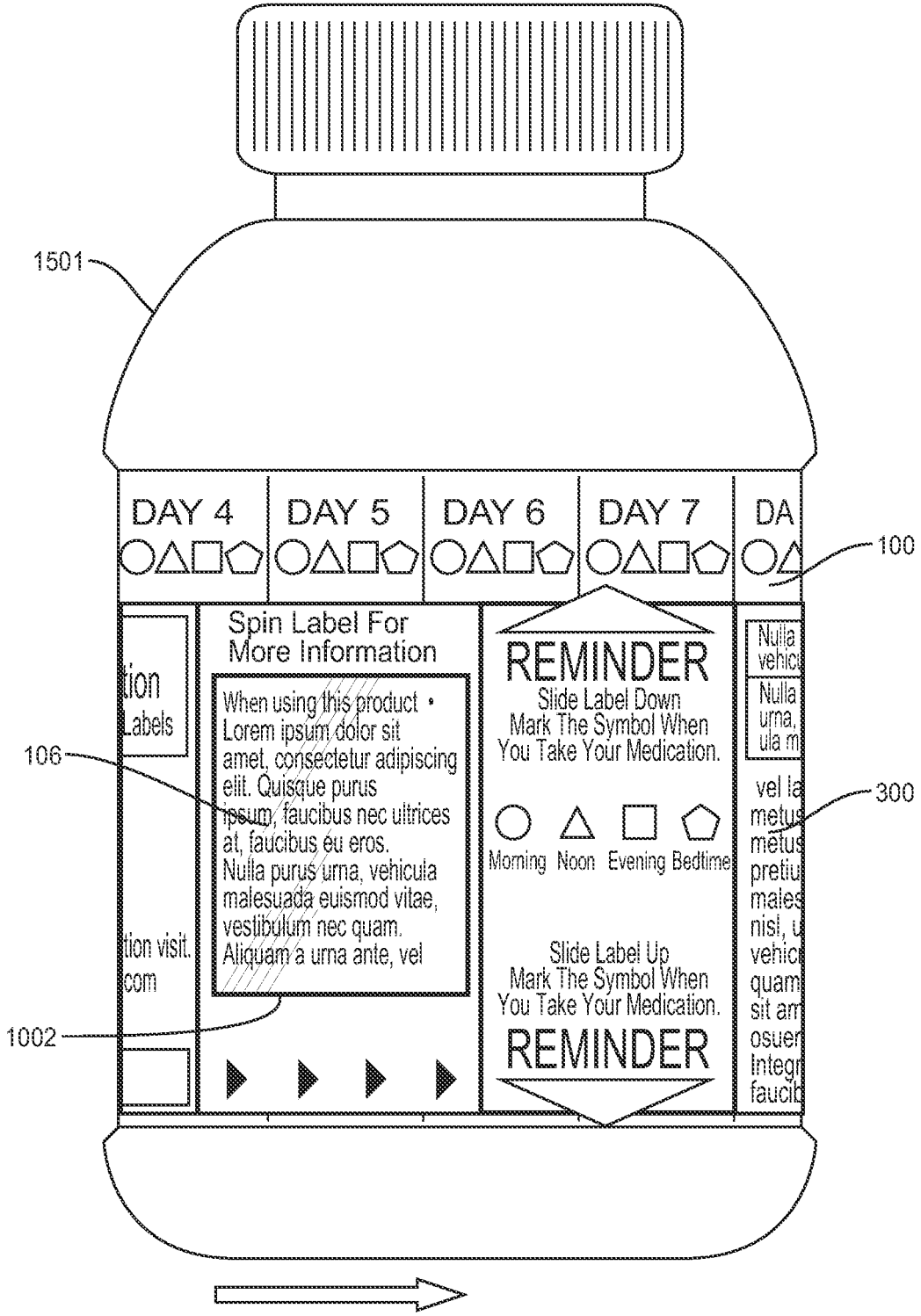
FIG. 18B illustrates an exemplary top label with a window affixed to an exemplary base label and secured about a container according to various embodiments.

As discussed previously, the top label 300 may comprise a transparent window 1002 to allow writing 106 (other than the day of week indicia 1205 or the time of day indicia 1210) on the base label 100 to be visible when the top label 300 is in place. FIG. 18A illustrates various embodiments of writing 106 on the base label 100 positioned between the indicia 1205, 1210 at the top and bottom edges of the base label 100. When the top label 300 is placed on the medication container 1501 over base label 100, the window 1002 may allow the writing 106 to be visible through the window 1002. As the top label 300 is rotated around the medication container 1501 as indicated by the arrows, the writing 106 positioned along the base label 100 may appear in the window 1002.

Figure 19A:
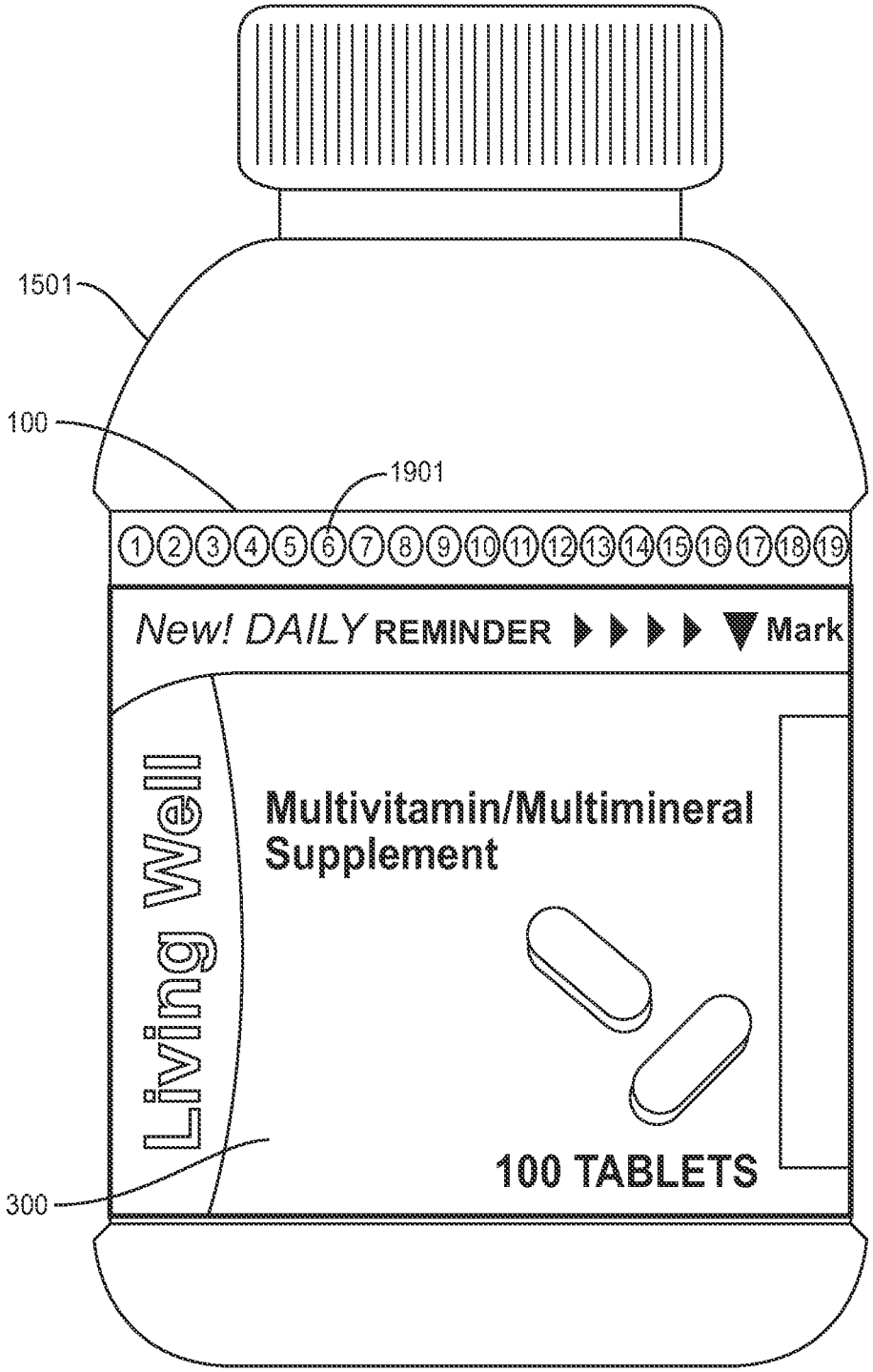
FIG. 19A illustrates an exemplary base label and top label secured about a container according to various embodiments.
Figure 19B:
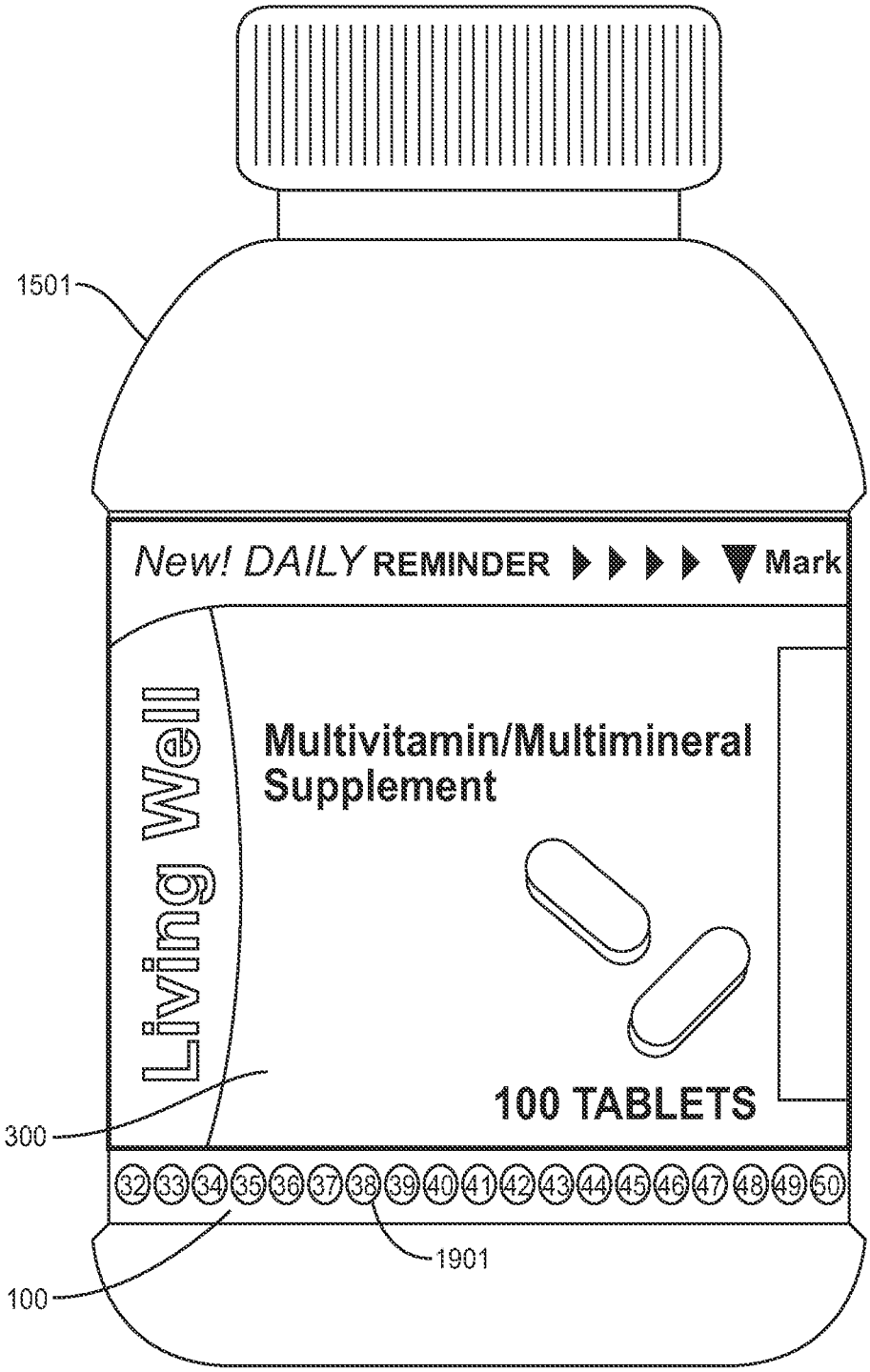
FIG. 19B illustrates an exemplary base label and top label secured about a container according to various embodiments.

FIG. 19A-B illustrate various embodiments of a patient compliance aid for a medication container 1501 comprising a base label 100 and top label 300. The base label may comprise an indicator 1901 that displays a symbol or character that may function to indicate the presence of medication within the medication container 1501, or may function to indicate a quantity of medication removed from the medication container 1501 and administered to a patient. In the examples of FIGS. 19A-B, the top label 300 indicates that the medication container 1501 contains 100 tablets. The indicators 1901 along the top and bottom edges of the base label 100 may correspond to the number of tablets in the medication container 1501. In this example, the indicators 1901 along the top edge of the base label 100 may correspond to number 1 through 50, and the indicators 1901 along the bottom edge may correspond to number 51 through 100. The top label may be slidable upwards and downwards as described previously to reveal the indicators 1901 along the top and bottom edges of the base label 100.

The indicators 1901 may comprise a receiving mechanism associated with the indicators 1901, the receiving mechanism capable of receiving an entry when medication is removed from the medication container 1501. Similar to the indicia 1205, 1210 described previously, the receiving mechanism may comprise a markable surface capable of receiving a mark from a writing instrument such as a pen or pencil, or a scratchable surface. Each time medication is removed from the medication container 1501, one of the symbols or characters comprising the indicator 1901 may be marked or scratched.

Figure 20:
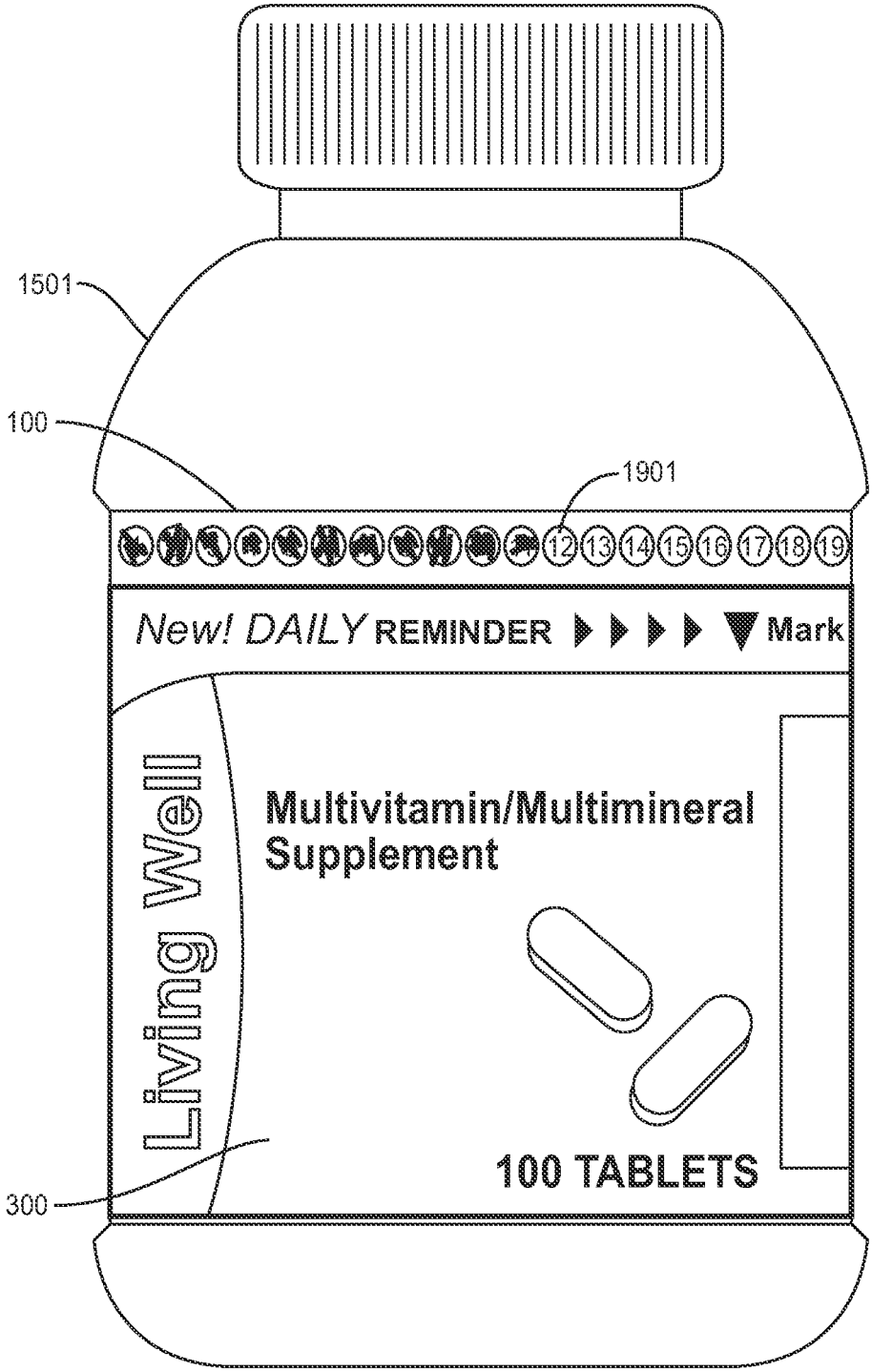
FIG. 20 illustrates an exemplary base label and top label secured about a container according to various embodiments.

FIG. 20 illustrates the 100 tablet medication container of FIG. 19 with the numbers 1-11 of the indicator 1901 marked. This may indicate that 11 tablets have been removed from the medicine container and administered to the patient. Alternatively, marking of the indicator 1901 could have started at 100 and counted backward as each tablet is removed from the medication container 1501. In this example, the next number of the indicator 1901 after the last marked number indicates the number of tablets remaining in the medication container 1501 and available to be administered to the patient.

Figure 21:
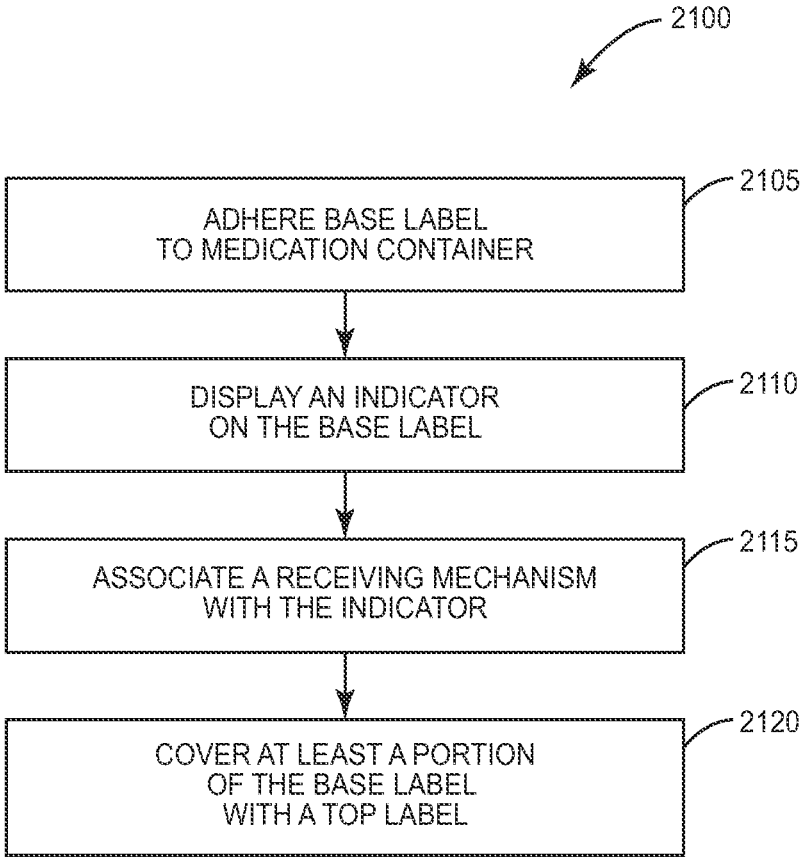
FIG. 21 is an exemplary flow diagram of a method for patient compliance with a regimen for administration of medication according to various embodiments.

FIG. 21 illustrates a general flow chart of various embodiments of a method 2100 for patient compliance with a regimen for administration of medication from a medication container. A base label 100 may be applied to a medication container 1501 (step 2105). An indicator 1901 comprising a symbol or character may be displayed on the base label 100 (step 2110). The symbol or character may represent that medication remains in the medication container 1501. A receiving mechanism may be associated with the indicator 1901 (step 2115). The receiving mechanism may comprise a markable or scratchable substance capable of receiving an entry when the medication is removed from the medication container 1501 and administered to the patient. At step 2120, at least a portion of the base label 100 may be covered with a top label 300. In various embodiments, a time indicator may be associated with the indicator 1901 on the base label 100, the time indicator representing a time when the medication should be taken by the patient.

In various embodiments, the day of week indicia 1205, time of day indicia 1210, writing 106, and indicator 1901 may be imprinted, embossed, or molded directly on the medication container in place of all or a portion of the base label 100.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A patient compliance aid for a medication container, the patient compliance aid comprising:

a base label adhered to the medication container;

an indicator on the base label, the indicator displaying a symbol or a character;

a receiving mechanism associated with the indicator, the receiving mechanism receiving an entry when medication is removed from the medication container; and a top label covering at least a portion of the base label, the top label having a dual ply construction with a vertical height less than a corresponding vertical height of the base label, the top label configured for rotating around a circumference of the base label and the top label configured for sliding in a vertical dimension over the base label, with the sliding without the rotating resulting in exposure of a previously covered segment of the portion of the base label.

2. The patient compliance aid of claim 1, the patient compliance aid further comprising:

a time indicator associated with the indicator on the base label, the time indicator representing a time.

3. The patient compliance aid of claim 2, wherein the time is a time for medication to be removed from the container.

4. The patient compliance aid of claim 2, wherein the time is a time for medication to be administered to a patient.

5. The patient compliance aid of claim 1, wherein the indicator indicates a presence of the medication within the container.

6. The patient compliance aid of claim 1, wherein the indicator indicates a quantity of the medication within the container.

7. The patient compliance aid of claim 1, wherein the indicator indicates a quantity of medication removed from the container.

8. The patient compliance aid of claim 1, wherein the indicator indicates a quantity of the medication within the container to be administered to a patient.

9. The patient compliance aid of claim 1, wherein the indicator indicates a quantity of medication removed from the container and administered to a patient.

10. The patient compliance aid of claim 1, wherein the receiving mechanism also receives an entry when the medication is administered to a patient.

11. A method for patient compliance with a regimen for administration of medication from a medication container, the method comprising:

adhering a base label to the medication container;

displaying an indicator on the base label, the indicator including a symbol or a character representing that medication remains in the medication container;

associating a receiving mechanism with the indicator, the receiving mechanism receiving an entry when the medication is removed from the medication container and administered to the patient; and covering at least a portion of the base label with a top label, the top label having a dual ply construction with a vertical height less than a corresponding vertical height of the base label, the top label configured for rotating around a circumference of the base label and the top label configured for sliding in a vertical dimension over the base label, with the sliding without the rotating resulting in exposure of a previously covered segment of the portion of the base label.

12. The method of claim 11, the method further comprising: associating a time indicator with the indicator on the base label, the time indicator representing a time when the medication should be taken by the patient.

13. A compliance aid for a medication container, the compliance aid comprising:

a base label adhered to the medication container;

a day of week indicia on the base label;

a time of day indicia associated with the day of week indicia on the base label; and a top label covering at least a portion of the base label, the top label having a dual ply construction with a vertical height less than a corresponding vertical height of the base label, the top label configured for rotating around a circumference of the base label and the top label configured for sliding in a vertical dimension over the base label, with the sliding without the rotating resulting in exposure of a previously covered segment of the portion of the base label.

14. The compliance aid for the medication container of claim 13, wherein the day of week indicia is markable with a pen or pencil.

15. The compliance aid for the medication container of claim 13, wherein the day of week indicia further comprises a scratchable substance.

16. The compliance aid for the medication container of claim 13, wherein the time of day indicia is markable with a pen or pencil.

17. The compliance aid for the medication container of claim 13, wherein the time of day indicia further comprises a scratchable substance.

18. The compliance aid for the medication container of claim 13, wherein the time of day indicia has a shape corresponding to a specific time of day.

19. The compliance aid for the medication container of claim 13, the top label further comprising:

a reminder indicia printed on the top label.

20. The compliance aid for the medication container of claim 19, wherein the reminder indicia rotates to correspond to the day of week indicia.

21. The compliance aid for the medication container of claim 19, wherein the reminder indicia rotates to correspond to the time of day indicia.

22. The compliance aid for the medication container of claim 13, the top label further comprising:

a transparent window within a portion of the top label.

23. The compliance aid for the medication container of claim 13, wherein the top label slides over the base label.

24. The compliance aid for the medication container of claim 13, wherein the top label rotates over the base label.

25. The compliance aid for the medication container of claim 13, wherein the top label further comprises:

a legend identifying the time of day indicia.

26. The compliance aid for the medication container of claim 13, wherein the top label further comprises:

any of medication-related information, patient-related information or medical-provider related information.

27. The compliance aid for the medication container of claim 13, wherein the medication container is a bottle.

28. The compliance aid for the medication container of claim 13, wherein the top label slides over the day of week indicia.

29. The compliance aid for the medication container of claim 13, wherein the top label slides over the time of day indicia.

30. The compliance aid for the medication container of claim 13, wherein the base label further comprises:

a second day of week indicia on the base label, the second day of week indicia located on an end opposite the day of week indicia.

31. The compliance aid for the medication container of claim 13, wherein the base label further comprises:

a second time of day indicia on the base label, the second time of day indicia located on an end opposite the time of day indicia.

32. The compliance aid for the medication container of claim 31, wherein the top label covers one indicia and not the second indicia.

* * * * *